US010984939B2

(12) United States Patent
Endo et al.

(10) Patent No.: US 10,984,939 B2
(45) Date of Patent: Apr. 20, 2021

(54) MULTILAYER COIL COMPONENT

(71) Applicant: TDK CORPORATION, Tokyo (JP)

(72) Inventors: Takashi Endo, Tokyo (JP); Kenji Komorita, Tokyo (JP); Kunihiko Kawasaki, Tokyo (JP); Hidekazu Sato, Tokyo (JP); Takashi Suzuki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/419,522

(22) Filed: Jan. 30, 2017

(65) Prior Publication Data

US 2018/0218829 A1 Aug. 2, 2018

(51) Int. Cl.
*H01F 5/00* (2006.01)
*H01F 17/00* (2006.01)

(52) U.S. Cl.
CPC ..... *H01F 17/0033* (2013.01); *H01F 17/0013* (2013.01); *H01F 2017/0066* (2013.01)

(58) Field of Classification Search
CPC . H01L 2924/19042; H01L 2924/30107; H01L 23/645; H01L 23/5227; H01F 17/0013; H01F 2017/004; H01F 2027/2809; H01F 27/2804; H01F 2017/0066
USPC ..... 336/200
See application file for complete search history.

(56) References Cited

U.S. PATENT DOCUMENTS 5,479,695 A * 1/1996 Grader ..... H01F 17/0033 156/89.28
6,198,373 B1 * 3/2001 Ogawa ..... H01F 17/0033 336/83
6,839,955 B2 * 1/2005 Uchikoba ..... H01F 27/027 228/248.1
6,855,222 B2 * 2/2005 Konoue ..... B32B 18/00 156/89.16
8,004,381 B2 * 8/2011 Katayama ..... H01F 17/0013 252/62.6

(Continued)

FOREIGN PATENT DOCUMENTS

CN 101529535 A 9/2009
JP H04-364710 A 12/1992

(Continued)

*Primary Examiner* — Alexander Talpalatski
*Assistant Examiner* — Joselito Baisa
(74) *Attorney, Agent, or Firm* — Oliff PLC

(57) ABSTRACT

A multilayer coil component includes an element body, a coil including a plurality of internal conductors, and a plurality of stress-relaxation spaces. The plurality of internal conductors are separated from each other in a first direction in the element body. Each stress-relaxation space is in contact with a surface of the corresponding internal conductor and powders exist in each stress-relaxation space. The element body includes element body regions located between the internal conductors adjacent to each other in the first direction. Each stress-relaxation space includes a first boundary surface with each internal conductor and a second boundary surface with each element body region. The first boundary surface and the second boundary surface oppose each other in the first direction. A distance between the first boundary surface and the second boundary surface is smaller than a thickness of each element body region in the first direction.

8 Claims, 16 Drawing Sheets

(56) References Cited

U.S. PATENT DOCUMENTS 8,427,265 B2 * 4/2013 Hachiya ..... H01F 17/0013 336/83
9,373,441 B2 * 6/2016 Noma ..... H01F 27/34
9,711,273 B2 * 7/2017 Suzuki ..... H01F 27/255
2007/0205956 A1 * 9/2007 Hashimoto ..... H01L 23/3114 343/866
2010/0033286 A1 2/2010 Katayama et al.
2011/0133881 A1 * 6/2011 Nakajima ..... H01F 3/14 336/200
2012/0326827 A1 * 12/2012 Nanjyo ..... H01F 17/0033 336/200
2013/0002389 A1 1/2013 Son et al.
2013/0154786 A1 * 6/2013 Nakajima ..... H01F 5/003 336/200
2013/0221959 A1 * 8/2013 Oki ..... G01R 15/207 324/258
2013/0222104 A1 * 8/2013 Kitamura ..... H01F 41/046 336/200
2014/0145816 A1 * 5/2014 Sato ..... H01F 17/0013 336/208
2014/0197917 A1 * 7/2014 Naito ..... H01F 17/0013 336/200
2015/0099115 A1 * 4/2015 Maeda ..... H01F 1/01 428/370
2015/0302980 A1 * 10/2015 Noma ..... H01F 27/34 336/200
2016/0314891 A1 * 10/2016 Onozaki ..... H01F 27/2804
2017/0012015 A1 * 1/2017 Tsukao ..... B32B 27/08
2017/0073481 A1 * 3/2017 Nomura ..... H01L 24/19
2017/0103842 A1 * 4/2017 Nagai ..... H01F 27/245
2019/0096561 A1 * 3/2019 Nagai ..... H01F 27/34

FOREIGN PATENT DOCUMENTS

JP H06-096953 A 4/1994
JP H08-064421 A 3/1996
JP 10247603 A * 9/1998 ..... H01F 41/16
JP 2006-253322 A 9/2006
JP 2013-012741 A 1/2013
WO 2008/004633 A1 1/2008

* cited by examiner

MULTILAYER COIL COMPONENT

TECHNICAL FIELD

The present invention relates to a multilayer coil component.

BACKGROUND

Japanese Unexamined Patent Publication No. 2006-253322 discloses a multilayer coil component. The multilayer coil component includes an element body including a magnetic material, a coil including a plurality of internal conductors disposed to be separated from each other in a first direction in the element body, and a stress-relaxation portion formed to surround the entire coil.

The stress-relaxation portion is formed to surround the entire coil. Because the stress-relaxation portion is configured using powder, strength of the element body may be lowered. In a multilayer coil component described in Japanese Unexamined Patent Publication No. H6-96953, the stress-relaxation portion is formed to surround each internal conductor configuring the coil, not the entire coil.

SUMMARY

In the multilayer coil component described in Japanese Unexamined Patent Publication No. H6-96953, the element body includes an element body region located between the individual internal conductors adjacent to each other in the first direction. A thickness of the element body region in the first direction (hereinafter, simply referred to as the "thickness of the element body region") is smaller than an interval between the individual internal conductors adjacent to each other in the first direction. Therefore, if a thickness of the stress-relaxation portion increases, it is difficult to secure the thickness of the element body region. For example, a cross-section of each internal conductor is decreased without changing a length of a magnetic path, so that the thickness of the element body region can be secured. In which case, direct-current resistance of each internal conductor may increase. Also, the length of the magnetic path is increased without changing the cross-section of each internal conductor, so that the thickness of the element body region can be secured. In which case, the thickness of the element body may increase. That is, miniaturization of the multilayer coil component may not be realized.

When the thickness of the element body region is not sufficiently secured, cracks may occur between the individual internal conductors adjacent to each other in the first direction. When the cracks occur between the individual internal conductors adjacent to each other in the first direction, an interlayer short circuit in which the individual internal conductors short-circuit may occur. For this reason, there is a demand for a multilayer coil component in which the thickness of the element body region is sufficiently secured and internal stress occurring in the element body is relaxed.

An object of one aspect of the present invention is to provide a multilayer coil component in which thicknesses of element body regions are sufficiently secured and internal stress occurring in an element body is relaxed.

A multilayer coil component according to an aspect of the present invention includes an element body including a magnetic material, a coil including a plurality of internal conductors, and a plurality of stress-relaxation spaces. The plurality of internal conductors are separated from each other in a first direction in the element body and are electrically connected to each other. Each stress-relaxation space is in contact with a surface of the corresponding internal conductor and powders exist in each stress-relaxation space. The element body includes element body regions located between the internal conductors adjacent to each other in the first direction. Each stress-relaxation space includes a first boundary surface with each internal conductor and a second boundary surface with each element body region. The first boundary surface and the second boundary surface oppose each other in the first direction. A distance between the first boundary surface and the second boundary surface is smaller than a thickness of each element body region in the first direction.

In the multilayer coil component according to the aspect, the individual stress-relaxation spaces are in contact with the surfaces of the corresponding internal conductors. Therefore, the stress-relaxation spaces exist between the internal conductors adjacent to each other in the first direction and the element body regions located between the internal conductors. The stress-relaxation spaces relax internal stress occurring in the element body. The internal stress occurs due to a difference of thermal shrinkage rates of the internal conductors and the element body, for example. The distances between the first boundary surfaces and the second boundary surfaces in the stress-relaxation spaces are thicknesses of the stress-relaxation spaces in the first direction (hereinafter, simply referred to as the "thicknesses of the stress-relaxation spaces"). The thicknesses of the stress-relaxation spaces are smaller than thicknesses of the element body regions, which are located between the internal conductors adjacent to each other in the first direction, in the first direction (hereinafter, simply referred to as the "thicknesses of the element body regions"). That is, the thicknesses of the element body regions are larger than the thicknesses of at least the stress-relaxation spaces. Therefore, even when the stress-relaxation spaces exist between the internal conductors adjacent to each other in the first direction and the element body regions located between the internal conductors, the element body regions secure the sufficient thicknesses as compared with the stress-relaxation spaces. As a result, the thicknesses of the element body regions are sufficiently secured, and the internal stress occurring in the element body is relaxed.

In the multilayer coil component according to the aspect, each internal conductor may include a first surface facing one direction of the first direction and a second surface facing the other direction of the first direction. The surface with which each stress-relaxation space is contact may be the first surface. When the stress-relaxation spaces are in contact with the first surfaces, that is, the stress-relaxation spaces are formed on the first surfaces of the internal conductors, the stress-relaxation spaces are formed easily and the thicknesses of the element body regions are secured more easily, as compared with when the stress-relaxation spaces are formed on both the first surfaces and the second surfaces.

In the multilayer coil component according to the aspect, the first surface may have a planar shape. In this case, the stress-relaxation space is in contact with the first surface of the planar shape. Because the first surface on which the stress-relaxation space is formed has the planar shape, the stress-relaxation space is formed easily.

In the multilayer coil component according to the aspect, the first surface may include a first surface portion extending in a direction orthogonal to the first direction and a second surface portion inclined with respect to the first direction and the first surface portion. Each stress-relaxation space may be in contact with the first surface portion and the second surface portion. In which case, even when the first surface of the internal conductor includes the first surface portion and the second surface portion, the stress-relaxation space is in contact with the first surface portion and the second surface portion. Therefore, the internal stress occurring in the element body is relaxed surely.

In the multilayer coil component according to the aspect, an average particle diameter of the powders may be 0.1 μm or less. In which case, because fluidity of the powders is superior, the powders flexibly follow the behavior according to a difference of thermal shrinkage rates of the element body and the internal conductors. As a result, the internal stress occurring in the element body is relaxed more surely.

In the multilayer coil component according to the aspect, materials of the powders may be $ZrO_2$. In which case, $ZrO_2$ is hard to affect the magnetic material (for example, a ferrite material) included in the element body. Because a melting point of $ZrO_2$ is higher than a firing temperature of the magnetic material, $ZrO_2$ exists surely as the powders.

In the multilayer coil component according to the aspect, each internal conductor may contain metal oxide. When the internal conductor contains the metal oxide, a shrinkage rate at the time of firing conductive paste configuring the internal conductor is small as compared with when the internal conductor does not contain the metal oxide. For this reason, a cross-section of the internal conductor is large. Therefore, even when the cross-section of the internal conductor is large, the stress-relaxation space relaxes the internal stress occurring in the element body.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

Figure 1:
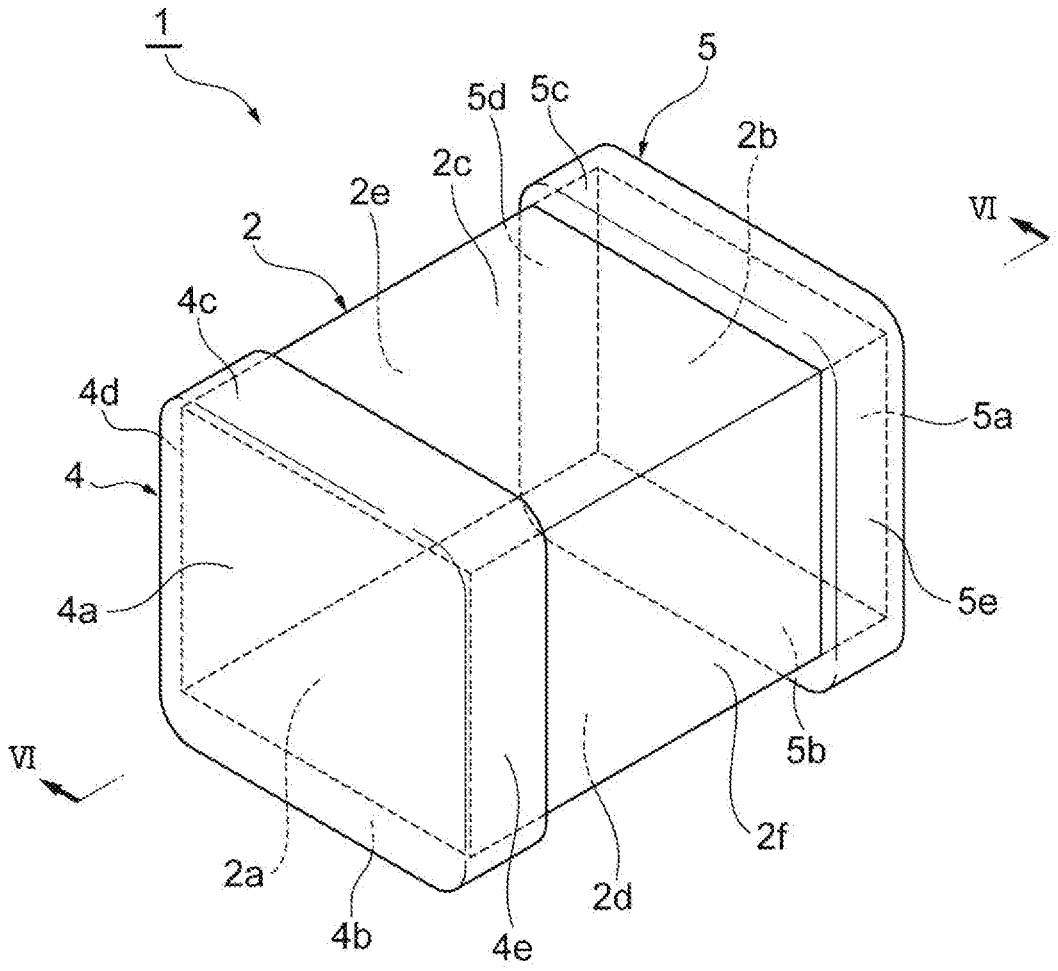
FIG. 1 is a perspective view illustrating a multilayer coil component according to a first embodiment.

Hereinafter, embodiments of the present invention will be described in detail with reference to the accompanying drawings. In the following description, the same elements or elements having the same functions are denoted with the same reference numerals and overlapped explanation is omitted.

First Embodiment

Figure 2:
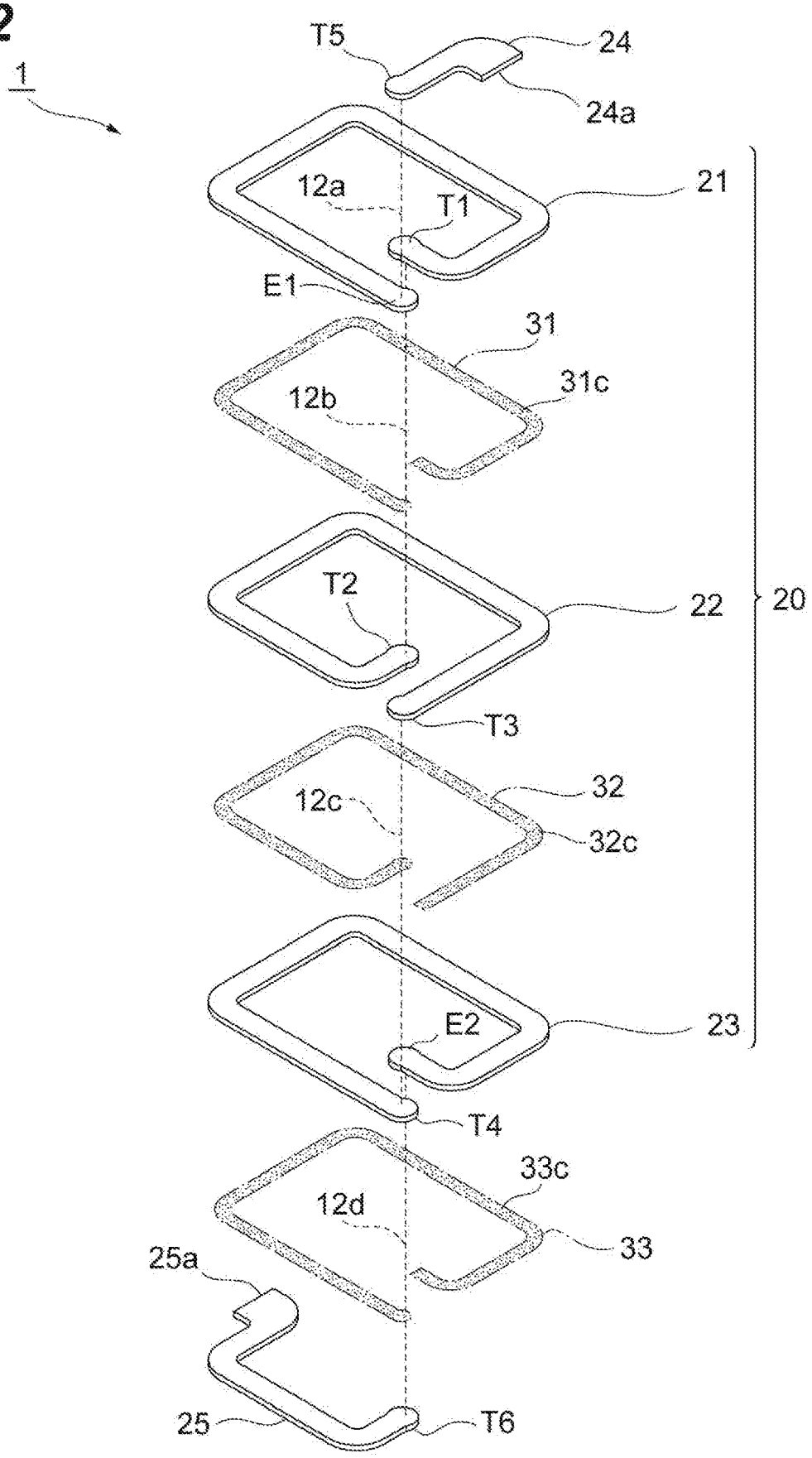
FIG. 2 is an exploded perspective view of the multilayer coil component illustrated in FIG. 1.
Figure 3:
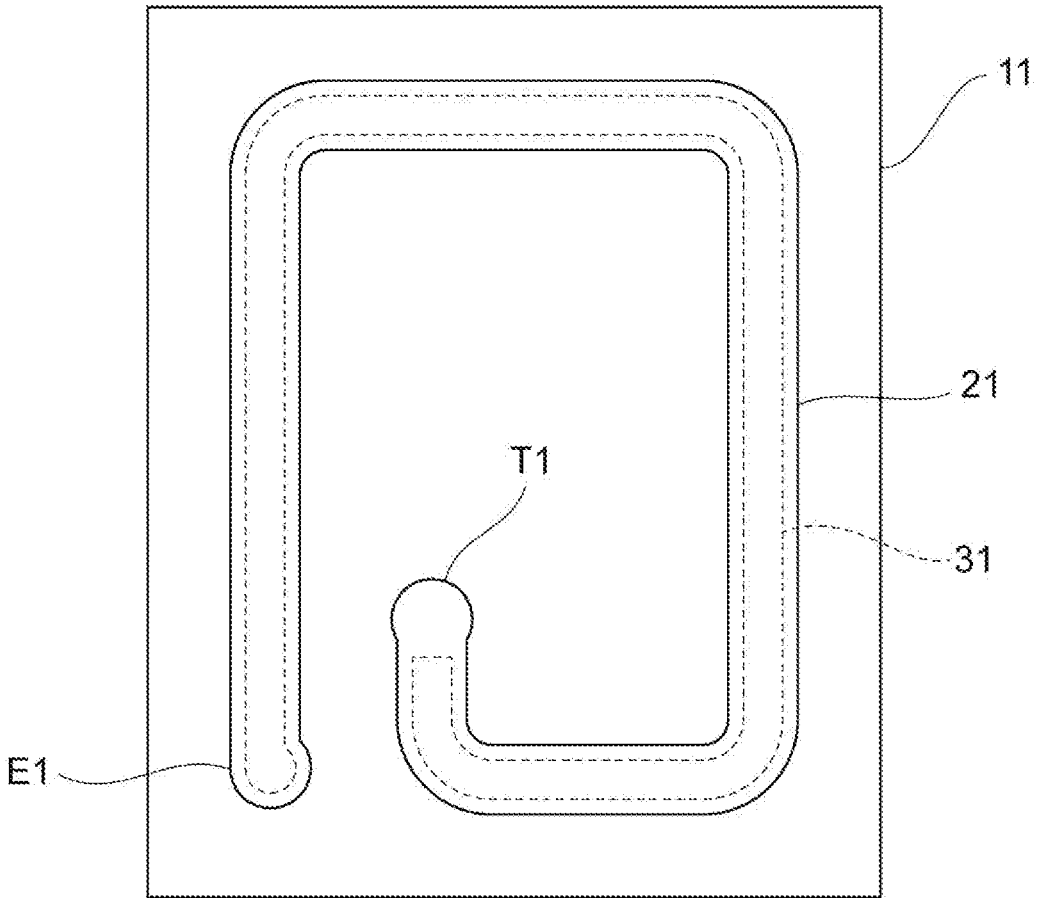
FIG. 3 is a plan view illustrating a coil conductor.
Figure 4:
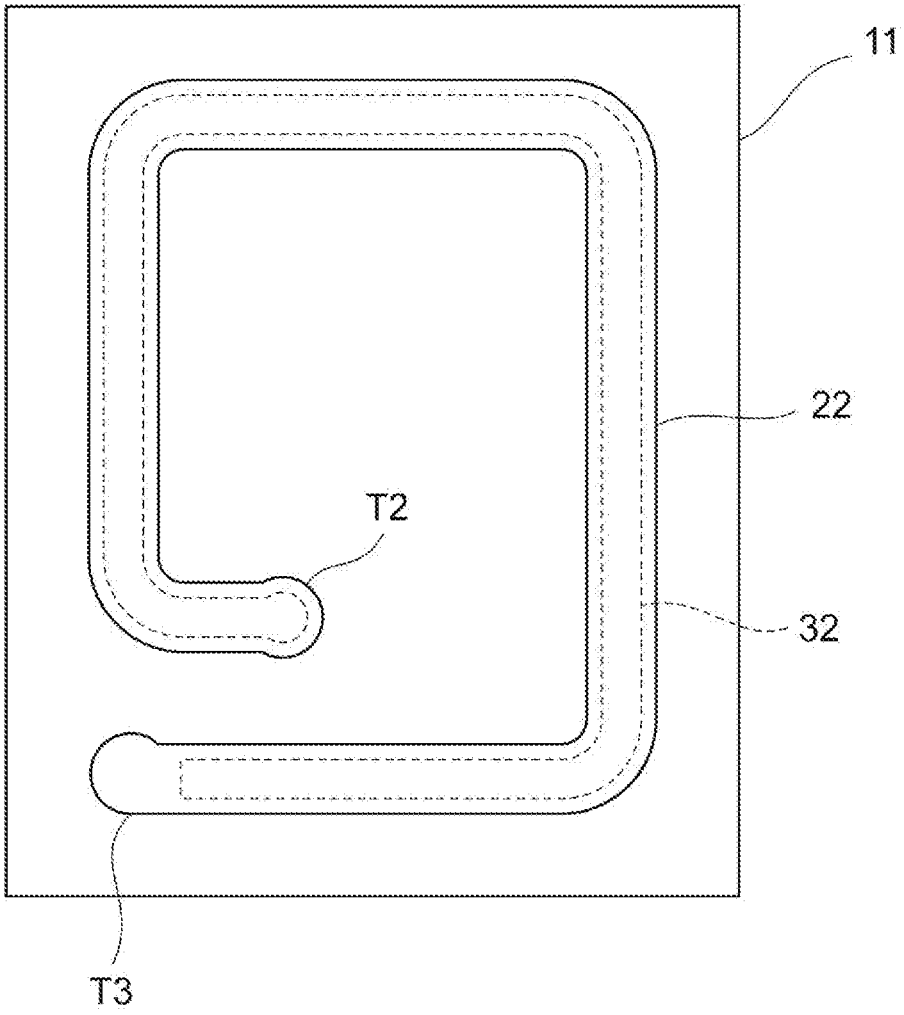
FIG. 4 is a plan view illustrating a coil conductor.
Figure 5:
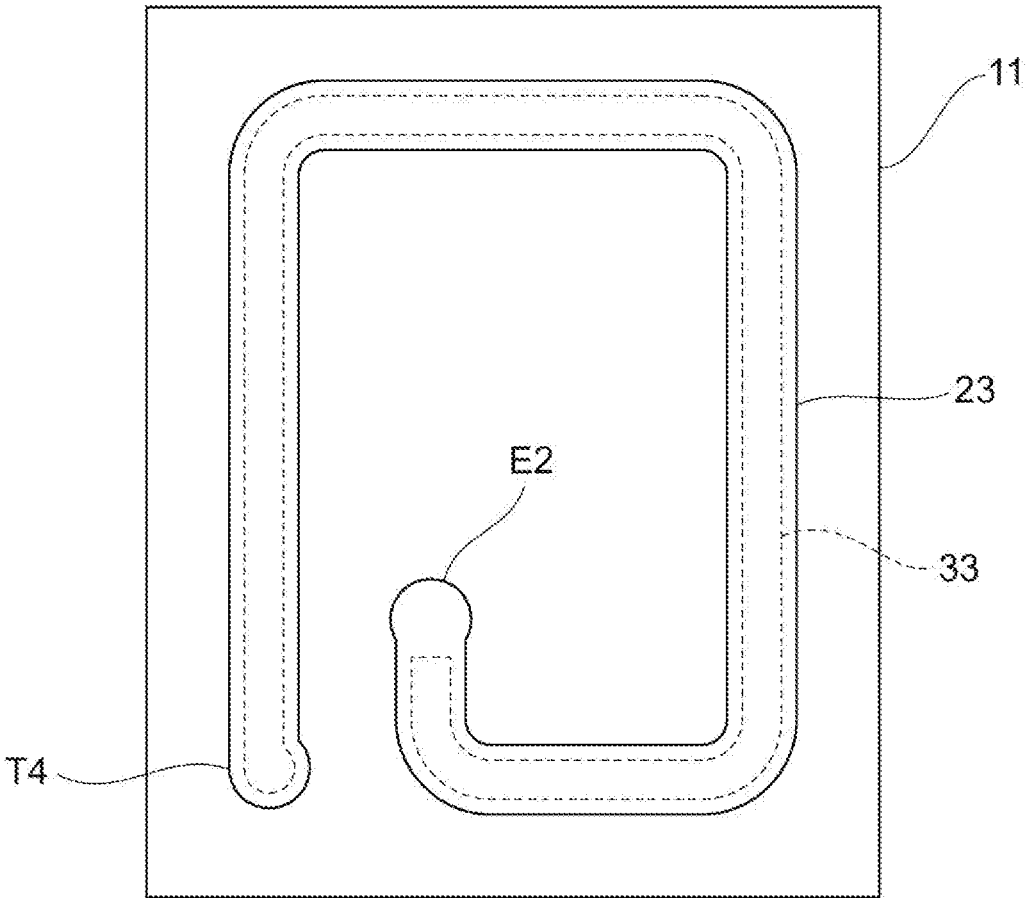
FIG. 5 is a plan view illustrating a coil conductor.
Figure 6:
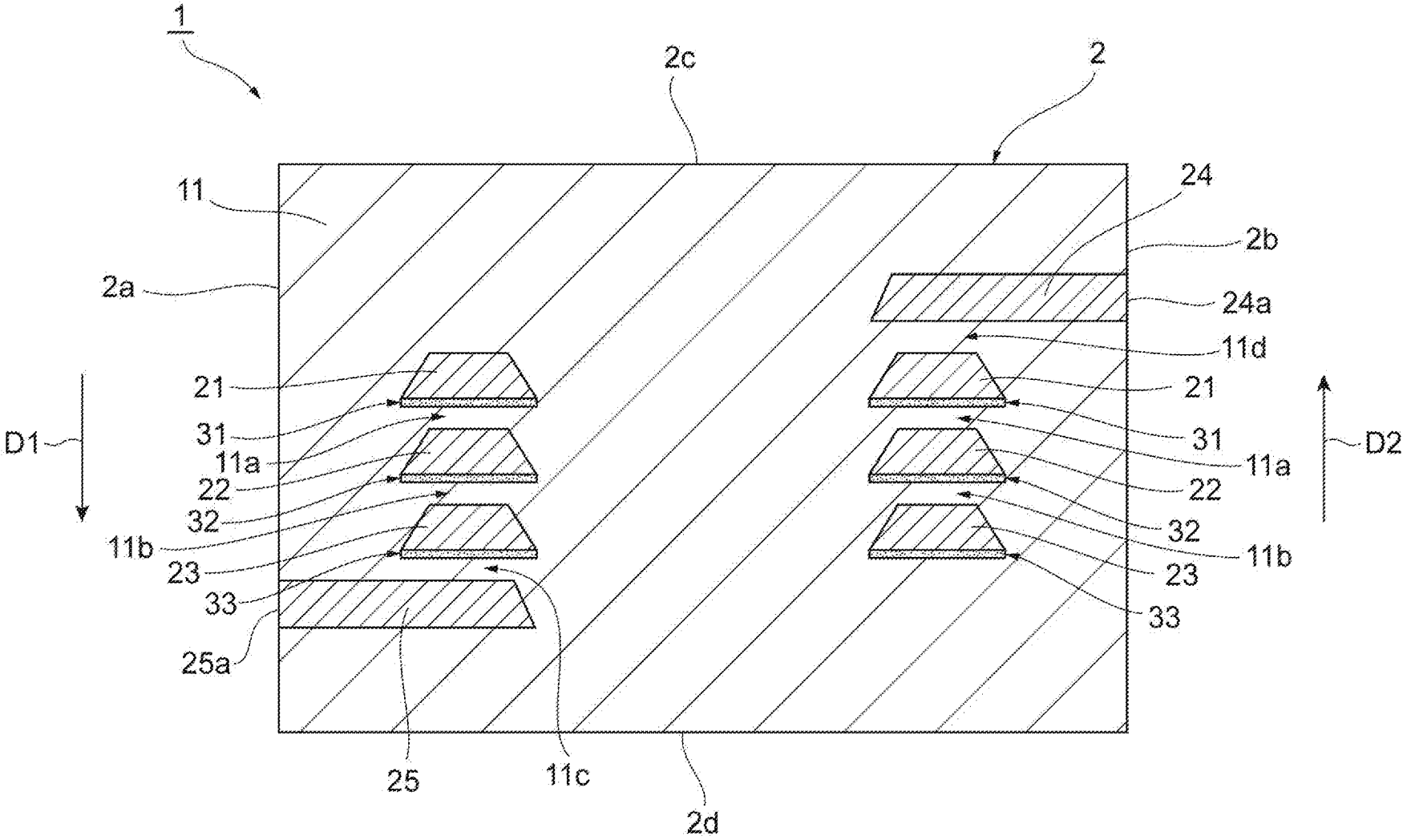
FIG. 6 is a cross-sectional view of an element body taken along the line VI to VI of FIG. 1.
Figure 7:
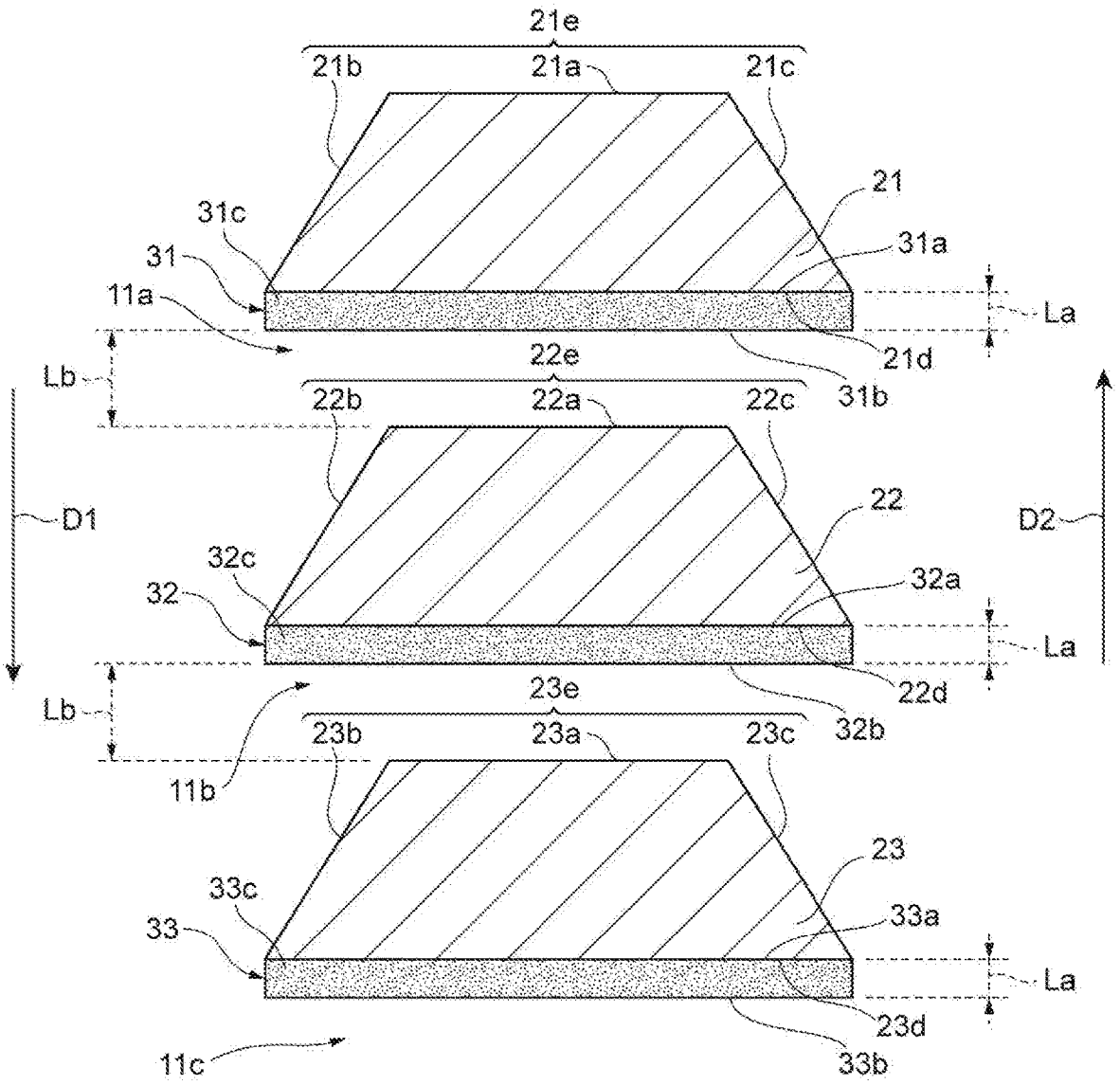
FIG. 7 is a diagram illustrating a part of FIG. 6.

A multilayer coil component 1 according to a first embodiment will be described with reference to FIGS. 1 to 7. FIG. 1 is a perspective view illustrating the multilayer coil component according to the first embodiment. FIG. 2 is an exploded perspective view of the multilayer coil component illustrated in FIG. 1. FIGS. 3 to 5 are plan views illustrating coil conductors. FIG. 6 is a cross-sectional view of an element body taken along the line VI to VI of FIG. 1. FIG. 7 is a diagram illustrating a part of FIG. 6. In FIG. 2, illustration of a plurality of magnetic material layers and external electrodes is omitted. In FIG. 6, illustration of the external electrodes is omitted.

As illustrated in FIG. 1, the multilayer coil component 1 includes an element body 2 and a pair of external electrodes 4 and 5. The external electrodes 4 and 5 are each disposed on both ends of the element body 2.

The element body 2 has a rectangular parallelepiped shape. The element body 2 includes a pair of end surfaces 2*a* and 2*b* opposing each other and four side surfaces 2*c*, 2*d*, 2*e*, and 2*f*, as external surfaces thereof. The four side surfaces 2*c*, 2*d*, 2*e*, and 2*f* extend in a direction in which the end surface 2*a* and the end surface 2*b* oppose each other, to connect the pair of end surfaces 2*a* and 2*b*. The side surface 2*d* is a surface opposing other electronic apparatus (for example, a circuit board or an electronic component) not illustrated in the drawings, when the multilayer coil component 1 is mounted on other electronic apparatus.

The direction in which the end surface 2*a* and the end surface 2*b* oppose each other, a direction in which the side surface 2*c* and the side surface 2*d* oppose each other, and a direction in which the side surface 2*e* and the side surface 2*f* oppose each other are approximately orthogonal to each other. The rectangular parallelepiped shape includes a shape of a rectangular parallelepiped in which a corner portion and a ridge portion are chamfered and a shape of a rectangular parallelepiped in which a corner portion and a ridge portion are rounded.

The element body 2 is configured by laminating a plurality of magnetic material layers 11 (refer to FIGS. 3 to 6). The plurality of magnetic material layers 11 are laminated in the direction in which the side surface 2*c* and the side surface 2*d* oppose each other. That is, a direction in which the plurality of magnetic material layers 11 are laminated is matched with the direction in which the side surface 2*c* and the side surface 2*d* oppose each other. Hereinafter, the direction in which the plurality of magnetic material layers 11 are laminated (that is, the direction in which the side surface 2*c* and the side surface 2*d* oppose each other) is also referred to as the "lamination direction". Each of the plurality of magnetic material layers 11 has an approximately rectangular shape. In the first embodiment, a direction toward the side surface 2*d* from the side surface 2*c* is one direction D1 of the lamination direction and a direction toward the side surface 2*c* from the side surface 2*d* is the other direction D2 of the lamination direction.

Each magnetic material layer 11 includes a sintered body of a green sheet including a magnetic material (a Ni—Cu—Zn based ferrite material, a Ni—Cu—Zn—Mg based ferrite material, or a Ni—Cu based ferrite material), for example. In the actual element body 2, the individual magnetic material layers 11 are integrated to a degree to which inter-layer boundaries cannot be visualized (refer to FIG. 6). A Fe alloy may be included in the green sheet configuring the magnetic material layer 11.

The external electrode 4 is disposed on the end surface 2*a* of the element body 2 and the external electrode 5 is disposed on the end surface 2*b* of the element body 2. That is, the external electrode 4 and the external electrode 5 are separated from each other in the direction in which the end surface 2*a* and the end surface 2*b* oppose each other. Each of the external electrodes 4 and 5 has an approximately rectangular shape in planar view and corners of the external electrodes 4 and 5 are rounded. The external electrodes 4 and 5 include a conductive material (for example, Ag or Pd). The external electrodes 4 and 5 include sintered bodies of conductive paste including conductive metal powder (for example, Ag powder or Pd powder) and glass frit. Electroplating is performed on the external electrodes 4 and 5 and plating layers are formed on surfaces of the external electrodes 4 and 5. When the electroplating is performed, for example, Ni or Sn is used.

The external electrode 4 includes five electrode portions. That is, the external electrode 4 includes an electrode portion 4*a* located on the end surface 2*a*, an electrode portion 4*b* located on the side surface 2*d*, an electrode portion 4*c* located on the side surface 2*c*, an electrode portion 4*d* located on the side surface 2*e*, and an electrode portion 4*e* located on the side surface 2*f*. The electrode portion 4*a* covers an entire surface of the end surface 2*a*. The electrode portion 4*b* covers a part of the side surface 2*d*. The electrode portion 4*c* covers a part of the side surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes five electrode portions. That is, the external electrode 5 includes an electrode portion 5*a* located on the end surface 2*b*, an electrode portion 5*b* located on the side surface 2*d*, an electrode portion 5*c* located on the side surface 2*c*, an electrode portion 5*d* located on the side surface 2*e*, and an electrode portion 5*e* located on the side surface 2*f*. The electrode portion 5*a* covers an entire surface of the end surface 2*b*. The electrode portion 5*b* covers a part of the side surface 2*d*. The electrode portion 5*c* covers a part of the side surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

As illustrated in FIGS. 2 to 6, the multilayer coil component 1 includes a plurality of coil conductors 21, 22, and 23 (a plurality of internal conductors), a plurality of connection conductors 24 and 25, and a plurality of stress-relaxation spaces 31, 32, and 33, which are provided in the element body 2. In FIG. 2, the individual stress-relaxation spaces 31 to 33 are shown by dashed-dotted lines.

The coil conductors 21 to 23 and the connection conductors 24 and 25 are separated from each other in the lamination direction (first direction). The thicknesses of the coil conductors 21 to 23 and the connection conductors 24 and 25 in the lamination direction are approximately the same (refer to FIG. 6). Ends of the individual coil conductors 21 to 23 are connected by corresponding through-hole conductors 12*b* and 12*c*. An end T1 of the coil conductor 21 and an end T2 of the coil conductor 22 are connected by the through-hole conductor 12*b*. An end T3 of the coil conductor 22 and an end T4 of the coil conductor 23 are connected by the through-hole conductor 12*c*. The individual ends T1 to T4 of the coil conductors 21 to 23 are connected via the corresponding through-hole conductors 12*b* and 12*c*, so that a coil 20 is configured in the element body 2. That is, the multilayer coil component 1 includes the coil 20 in the element body 2. The coil 20 includes the plurality of coil conductors 21 to 23 that are separated from each other in the lamination direction and are electrically connected to each other. The coil 20 has an axial center along the lamination direction.

The coil conductor 21 is disposed at a position closest to the side surface 2*c* of the element body 2 in the lamination direction among the plurality of coil conductors 21 to 23. An end E1 of the coil conductor 21 configures one end E1 of the coil 20. The coil conductor 23 is disposed at a position closest to the side surface 2*d* of the element body 2 in the lamination direction among the plurality of coil conductors 21 to 23. An end E2 of the coil conductor 23 configures the other end E2 of the coil 20. A cross-sectional shape of each of the coil conductors 21 to 23 is approximately a trapezoidal shape (refer to FIG. 6). The cross-sectional shape of each of the coil conductors 21 to 23 is described in detail later with reference to FIG. 7.

The connection conductor 24 is disposed closer to the side surface 2*c* of the element body 2 than the coil conductor 21 in the lamination direction. The connection conductor 24 and the coil conductor 21 are adjacent to each other in the lamination direction. An end T5 of the connection conductor 24 is connected to the end E1 of the coil conductor 21 by a through-hole conductor 12*a*. That is, the connection conductor 24 and the end E1 of the coil 20 are connected by the through-hole conductor 12*a*.

An end 24*a* of the connection conductor 24 is exposed to the end surface 2*b* of the element body 2. The end 24*a* is connected to the electrode portion 5*a* covering the end surface 2*b*. That is, the connection conductor 24 and the external electrode 5 are connected. Therefore, the end E1 of the coil 20 and the external electrode 5 are electrically connected via the connection conductor 24 and the through-hole conductor 12*a*.

The connection conductor 25 is disposed closer to the side surface 2*d* of the element body 2 than the coil conductor 23 in the lamination direction. The connection conductor 25 and the coil conductor 23 are adjacent to each other in the lamination direction. An end T6 of the connection conductor 25 is connected to the end E2 of the coil conductor 23 by the through-hole conductor 12*d*. That is, the connection conductor 25 and the end E2 of the coil 20 are connected by the through-hole conductor 12*d*.

An end 25*a* of the connection conductor 25 is exposed to the end surface 2*a* of the element body 2. The end 25*a* is connected to the electrode portion 4*a* of the external electrode 4 covering the end surface 2*a*. That is, the connection conductor 25 and the external electrode 4 are connected. Therefore, the end E2 of the coil 20 and the external electrode 4 are electrically connected via the connection conductor 25 and the through-hole conductor 12*d*.

The coil conductors 21 to 23, the connection conductors 24 and 25, and the through-hole conductors 12*a* to 12*d* include a conductive material (for example, Ag or Pd). The coil conductors 21 to 23, the connection conductors 24 and 25, and the through-hole conductors 12*a* to 12*d* include sintered bodies of conductive paste including conductive metal powder (for example, Ag powder or Pd powder). The coil conductors 21 to 23, the connection conductors 24 and 24, and the through-hole conductors 12*a* and 12*d* may contain metal oxide ($TiO_2$, $Al_2O_3$, or $ZrO_2$), for example. In which case, the coil conductors 21 to 23, the connection conductors 24 and 24, and the through-hole conductors 12*a* and 12*d* include sintered bodies of conductive paste including the metal oxide. In the conductive paste including the metal oxide, a shrinkage rate at the time of firing is small as compared with conductive paste not including the metal oxide.

The individual stress-relaxation spaces 31, 32, and 33 are in contact with the corresponding coil conductors 21 to 23. The stress-relaxation spaces 31 to 33 are spaces where powders 31*c*, 32*c*, and 33*c* exist, respectively. The individual stress-relaxation spaces 31 to 33 exist between the corresponding coil conductors 21 to 23 and element body regions in the element body 2 and relax internal stress occurring in the element body 2. A material of the powders 31*c*, 32*c*, and 33*c* is $ZrO_2$, for example. A melting point of $ZrO_2$ is about 2700° C. or more, for example, and is higher than a firing temperature of a ferrite material. An average particle diameter of the powders 31*c*, 32*c*, and 33*c* is 0.1 μm or less, for example.

The stress-relaxation space 31 is located between the coil conductor 21 and the coil conductor 22 in the lamination direction. As illustrated in FIG. 3, the stress-relaxation space 31 is formed on a surface 21*d* of the coil conductor 21 (refer to FIG. 7). The surface 21*d* is a lower surface of the coil conductor 21 in the lamination direction. That is, the surface 21*d* is a surface close to the side surface 2*d* in the lamination direction. The stress-relaxation space 31 is formed along a portion other than the end T1 of the coil conductor 21. That is, the stress-relaxation space 31 does not cover the end T1 of the coil conductor 21. The end T1 is a connection portion with the through-hole conductor 12*b*. The stress-relaxation space 31 is formed not to protrude from the coil conductor 21, when viewed from the lamination direction.

The stress-relaxation space 32 is located between the coil conductor 22 and the coil conductor 23 in the lamination direction. As illustrated in FIG. 4, the stress-relaxation space 32 is formed on a surface 22*d* of the coil conductor 22 (refer to FIG. 7). The surface 22*d* is a lower surface of the coil conductor 22 in the lamination direction. That is, the surface 22*d* is a surface close to the side surface 2*d* in the lamination direction. The stress-relaxation space 32 is formed along a portion other than the end T3 of the coil conductor 22. That is, the stress-relaxation space 32 does not cover the end T3 of the coil conductor 22. The end T3 is a connection portion with the through-hole conductor 12*c*. The stress-relaxation space 32 is formed not to protrude from the coil conductor 22, when viewed from the lamination direction.

The stress-relaxation space 33 is located between the coil conductor 23 and the connection conductor 25 in the lamination direction. As illustrated in FIG. 5, the stress-relaxation space 33 is formed on a surface 23*d* of the coil conductor 23 (refer to FIG. 7). The surface 23*d* is a lower surface of the coil conductor 23 in the lamination direction. That is, the surface 23*d* is a surface close to the side surface 2*d* in the lamination direction. The stress-relaxation space 33 is formed along a portion other than the end E2 of the coil conductor 23. That is, the stress-relaxation space 33 does not cover the end E2 of the coil conductor 23. The end E2 is a connection portion with the through-hole conductor 12*d*. The stress-relaxation space 33 is formed not to protrude from the coil conductor 23, when viewed from the lamination direction.

As illustrated in FIG. 6, the element body 2 includes element body regions 11*a* to 11*d* between the coil conductors 21 to 23 and the connection conductors 24 and 25 adjacent to each other in the lamination direction. The element body region 11*a* is located between the coil conductor 21 and the coil conductor 22. The element body region 11*a* is interposed by the stress-relaxation space 31 and the coil conductor 22. The element body region 11*b* is located between the coil conductor 22 and the coil conductor 23. The element body region 11*b* is interposed by the stress-relaxation space 32 and the coil conductor 23. The element body region 11*c* is located between the coil conductor 23 and the connection conductor 25. The element body region 11*c* is interposed by the stress-relaxation space 33 and the connection conductor 25. The element body region 11*d* is located between the coil conductor 21 and the connection conductor 24. The element body region 11*d* is interposed by the coil conductor 21 and the connection conductor 24.

Referring to FIG. 7, cross-sectional configurations of each of the coil conductors 21 to 23 and each of the stress-relaxation spaces 31 to 33 will be described. In FIG. 7, regions including parts (portions close to the end surface 2*a* of the element body 2) of the coil conductors 21 to 23 in FIG. 6 are expanded. Because configurations of regions including portions of the coil conductors 21 to 23 close to the end surface 2*b* of the element body 2 in FIG. 6 are the same as the configurations illustrated in FIG. 7, illustration is omitted.

As illustrated in FIG. 7, the coil conductor 21 includes surfaces 21*d* and 21*e*. The surface 21*d* faces the side of the side surface 2*d* of the element body 2 and the surface 21*e* faces the side of the side surface 2*c* of the element body 2. That is, in the first embodiment, the surface 21*d* is a first surface facing one direction D1 of the lamination direction and the surface 21*e* is a second surface facing the other direction D2 of the lamination direction. The surface 21*d* has a planar shape and is approximately orthogonal to the lamination direction. The surface 21*e* includes a planar portion 21*a* (first surface portion) and two inclined portions 21*b* and 21*c* (second surface portions).

The planar portion 21*a* has a planar shape and is approximately parallel to the surface 21*d*. That is, the planar portion 21*a* extends in a direction orthogonal to the lamination direction. An area of the planar portion 21*a* is smaller than an area of the surface 21*d*. Each of the inclined portions 21*b* and 21*c* has an inclined shape and is inclined with respect to the lamination direction and the surface 21*d*. The inclined portion 21*b* and the inclined portion 21*c* oppose each other. The inclined portion 21*b* and the inclined portion 21*c* are formed to connect the surface 21*d* and the planar portion 21*a*. The inclined portion 21*b* includes a first edge in one direction D1 of the lamination direction and a second edge in the other direction D2 of the lamination direction. The inclined portion 21*b* is inclined in such a manner that the first edge is closer to the end surface 2*a* than the second edge. The inclined portion 21*c* includes a first edge in one direction D1 of the lamination direction and a second edge in the other direction D2 of the lamination direction. The inclined portion 21*c* is inclined in such a manner that the first edge is closer to the end surface 2*b* than the second edge. That is, the inclined portion 21*b* and the inclined portion 21*c* are inclined to come close to each other in the other direction D2 of the lamination direction.

The coil conductor 22 includes surfaces 22*d* and 22*e*. The surface 22*d* faces the side of the side surface 2*d* of the element body 2 and the surface 22*e* faces the side of the side surface 2*c* of the element body 2. That is, in the first embodiment, the surface 22*d* is a first surface facing one direction D1 of the lamination direction and the surface 22*e* is a second surface facing the other direction D2 of the lamination direction. The surface 22*d* has a planar shape and is approximately orthogonal to the lamination direction. The surface 22*e* includes a planar portion 22*a* (first surface portion) and two inclined portions 22*b* and 22*c* (second surface portions).

The planar portion 22*a* has a planar shape and is approximately parallel to the surface 22*d*. That is, the planar portion 22*a* extends in a direction orthogonal to the lamination direction. An area of the planar portion 22*a* is smaller than an area of the surface 22*d*. Each of the inclined portions 22*b* and 22*c* has an inclined shape and is inclined with respect to the lamination direction and the surface 22*d*. The inclined portion 22*b* and the inclined portion 22*c* oppose each other. The inclined portion 22*b* and the inclined portion 22*c* are formed to connect the surface 22*d* and the planar portion 22*a*. The inclined portion 22*b* includes a first edge in one direction D1 of the lamination direction and a second edge in the other direction D2 of the lamination direction. The inclined portion 22*b* is inclined in such a manner that the first edge is closer to the end surface 2*a* than the second edge. The inclined portion 22*c* includes a first edge in one direction D1 of the lamination direction and a second edge in the other direction D2 of the lamination direction. The inclined portion 22*c* is inclined in such a manner that the first edge is closer to the end surface 2*b* than the second edge. That is, the inclined portion 22*b* and the inclined portion 22*c* are inclined to come close to each other in the other direction D2 of the lamination direction.

The coil conductor 23 includes surfaces 23*d* and 23*e*. The surface 23*d* faces the side of the side surface 2*d* of the element body 2 and the surface 23*e* faces the side of the side surface 2*c* of the element body 2. That is, in the first embodiment, the surface 23*d* is a first surface facing one direction D1 of the lamination direction and the surface 23*e* is a second surface facing the other direction D2 of the lamination direction. The surface 23*d* has a planar shape and is approximately orthogonal to the lamination direction. The surface 23*e* includes a planar portion 23*a* (first surface portion) and two inclined portions 23*b* and 23*c* (second surface portions).

The planar portion 23*a* has a planar shape and is approximately parallel to the surface 23*d*. That is, the planar portion 23*a* extends in a direction orthogonal to the lamination direction. An area of the planar portion 23*a* is smaller than an area of the surface 23*d*. Each of the inclined portions 23*b* and 23*c* has an inclined shape and is inclined with respect to the lamination direction and the surface 23*d*. The inclined portion 23*b* and the inclined portion 23*c* oppose each other. The inclined portion 23*b* and the inclined portion 23*c* are formed to connect the surface 23*d* and the planar portion 23*a*. The inclined portion 23*b* includes a first edge in one direction D1 of the lamination direction and a second edge in the other direction D2 of the lamination direction. The inclined portion 23*b* is inclined in such a manner that the first edge is closer to the end surface 2*a* than the second edge. The inclined portion 23*c* includes a first edge in one direction D1 of the lamination direction and a second edge in the other direction D2 of the lamination direction. The inclined portion 23*c* is inclined in such a manner that the first edge is closer to the end surface 2*b* than the second edge. That is, the inclined portion 23*b* and the inclined portion 23*c* are inclined to come close to each other in the other direction D2 of the lamination direction.

The stress-relaxation space 31 includes a first boundary surface 31*a* with the coil conductor 21 and a second boundary surface 31*b* with the element body region 11*a*. The first boundary surface 31*a* is in contact with the surface 21*d* of the coil conductor 21. The second boundary surface 31*b* is in contact with the element body region 11*a*. The first boundary surface 31*a* and the second boundary surface 31*b* oppose each other in the lamination direction.

The stress-relaxation space 32 includes a first boundary surface 32*a* with the coil conductor 22 and a second boundary surface 32*b* with the element body region 11*b*. The first boundary surface 32*a* is in contact with the surface 22*d* of the coil conductor 22. The second boundary surface 31*b* is in contact with the element body region 11*b*. The first boundary surface 32*a* and the second boundary surface 32*b* oppose each other in the lamination direction.

The stress-relaxation space 33 includes a first boundary surface 33*a* with the coil conductor 23 and a second boundary surface 33*b* with the element body region 11*c*. The first boundary surface 33*a* is in contact with the surface 23*d* of the coil conductor 23. The second boundary surface 32*b* is in contact with the element body region 11*c*. The first boundary surface 33*a* and the second boundary surface 33*b* oppose each other in the lamination direction.

The thicknesses (hereinafter, simply referred to as the "thicknesses La") of the stress-relaxation spaces 31 to 33 in the lamination direction are defined as distances between the first boundary surfaces 31*a* to 33*a* and the second boundary surfaces 31*b* to 33*b* opposing each other. In the first embodiment, the thickness La of the stress-relaxation space 31 is a distance between the first boundary surface 31*a* and the second boundary surface 31*b*. The thickness La of the stress-relaxation space 32 is a distance between the first boundary surface 32*a* and the second boundary surface 32*b*. The thickness La of the stress-relaxation space 33 is a distance between the first boundary surface 33*a* and the second boundary surface 33*b*. The thicknesses La of the individual stress-relaxation spaces 31 to 33 are equivalent. The same does not necessarily mean only that values are exactly equal. Even when minute differences in a predetermined range or manufacturing errors are included in the values, it may be assumed that the values are the same.

The thicknesses (hereinafter, simply referred to as the "thicknesses Lb") of the element body regions 11*a* and 11*b* in the lamination direction are defined as shortest distances of the element body regions 11*a* and 11*b* in the lamination direction. In the first embodiment, the thickness Lb of the element body region 11*a* is a distance between the second boundary surface 31*b* and the planar portion 22*a*. The thickness Lb of the element body region 11*b* is a distance between the second boundary surface 32*b* and the planar portion 23*a*. The thicknesses Lb of the element body regions 11*a* and 11*b* are the same.

The thicknesses La of the stress-relaxation spaces 31 to 33 are smaller than the thicknesses Lb of the element body regions 11*a* and 11*b*. That is, the thicknesses Lb of the element body regions 11*a* and 11*b* are larger than the thicknesses La of at least the stress-relaxation spaces 31 to 33. Therefore, as compared with the thickness of the stress-relaxation space 31, the thickness Lb of the element body region 11*a* is sufficiently secured between the coil conductor 21 and the coil conductor 22. As compared with the thickness of the stress-relaxation space 32, the thickness Lb of the element body region 11*b* is sufficiently secured between the coil conductor 22 and the coil conductor 23. The thicknesses La of the stress-relaxation spaces 31 to 33 are about 1 to 2 μm, for example. The thicknesses Lb of the element body regions 11*a* and 11*b* are about 3 to 30 μm, for example. A difference of the thicknesses Lb of the element body regions 11*a* and 11*b* and the thicknesses La of the stress-relaxation spaces 31 to 33 may be 5 to 20, for example.

Although illustration is omitted, the thickness of the element body region 11*c* in the lamination direction is defined as a shortest distance of the element body region 11*c* in the lamination direction, similar to the thicknesses Lb of the element body regions 11*a* and 11*b*. The thickness of the element body region 11*c* in the lamination direction is the same as the thicknesses Lb of the element body regions 11*a* and 11*b*. Hereinafter, the thickness of the element body region 11*c* in the lamination direction is also simply referred to as the "thickness Lb". The thickness La of the stress-relaxation space 33 is smaller than the thickness Lb of the element body region 11*c*. That is, the thickness Lb of the element body region 11*c* is larger than the thickness La of at least the stress-relaxation space 33. Therefore, as compared with the thickness of the stress-relaxation space 33, the thickness Lb of the element body region 11*c* is sufficiently secured between the coil conductor 23 and the connection conductor 25.

The stress-relaxation spaces 31 to 33 may be completely filled with the powders 31*c* to 33*c* and gaps may be formed between the powders 31*c* to 33*c*. That is, the powders 31*c* to 33*c* may be disposed densely in the stress-relaxation spaces 31 to 33 to be in contact with the coil conductors 21 to 23 and the element body regions 11*a* to 11*c* and may exist with gaps between at least one of the coil conductors 21 to 23 and the element body regions 11*a* to 11*c*. The gaps are formed when organic solvents contained in materials to form the stress-relaxation spaces 31 to 33 disappear at the time of firing, for example.

Even when the gaps are formed between the powders 31*c* to 33*c*, the thicknesses La of the stress-relaxation spaces 31 to 33 are defined as the distances between the first boundary surfaces 31*a* to 33*a* and the second boundary surfaces 31*b* to 33*b*, as described above. That is, the thicknesses La of the stress-relaxation spaces 31 to 33 are defined as the thicknesses of the stress-relaxation spaces 31 to 33 including the gaps, not the thicknesses of only the regions where the powders 31*c* to 33*c* other than the gaps exist.

In the element body 2, the gaps may be formed between the element body regions 11*a* to 11*c* and the conductors due to a difference of shrinkage rates of the material to form the element body 2 and the material to form the conductors 21 to 25. That is, the element body regions 11*a* to 11*c* may not be in contact with the conductors 21 to 25. Even when the gaps are formed between the element body regions 11*a* to 11*c* and the conductors 21 to 25, the thicknesses Lb of the element body regions 11*a* to 11*c* are defined as the shortest distances of the element body regions 11*a* to 11*c* in the lamination direction, as described above. When the gaps are formed between the element body regions 11*a* to 11*c* and the conductors 21 to 25, the shortest distances of the element body regions 11*a* to 11*c* in the lamination direction are small as compared with when the gaps are not formed. For example, when the gap is not formed between the element body region 11*a* and the coil conductor 22, the thickness Lb of the element body region 11*a* is a distance between the second boundary surface 31*b* and the planar portion 22*a*. For example, when the gap is formed between the element body region 11*a* and the coil conductor 22 (planar portion 22*a*), the thickness Lb of the element body region 11*a* is a distance between the second boundary surface 31*b* and a boundary surface with the gap. For example, when the gap is not formed between the element body region 11*b* and the coil conductor 23, the thickness Lb of the element body region 11*b* is a distance between the second boundary surface 32*b* and the planar portion 23*a*. For example, when the gap is formed between the element body region 11*b* and the coil conductor 23 (planar portion 23*a*), the thickness Lb of the element body region 11*b* is a distance between the second boundary surface 32*b* and a boundary surface with the gap.

Next, a course of forming conductor patterns corresponding to the individual coil conductors 21 to 23 and powder patterns corresponding to the individual stress-relaxation spaces 31 to 33 on a non-burned ceramic green sheet becoming the magnetic material layers 11 will be described.

First, the powder patterns becoming the individual stress-relaxation spaces 31 to 33 after firing are formed on the ceramic green sheet by applying paste including $ZrO_2$. The application of the paste is performed by screen printing, for example. The paste including $ZrO_2$ is made by mixing $ZrO_2$ powders and organic solvents and organic binders. Next, the conductor patterns becoming the individual coil conductors 21 to 23 after the firing are formed on the individual powder patterns formed on the ceramic green sheet by applying the conductive paste. The conductive paste is made by mixing conductor powders and organic solvents and organic binders. The application of the conductive paste is performed by the screen printing, for example. The conductor powders included in the conductor patterns become are sintered by the firing and become the coil conductors 21 to 23. The powder patterns become the stress-relaxation spaces 31 to 33 where the powders 31*c* to 33*c* exist, by the firing. An average particle diameter of the powders 31*c* to 33*c* existing in the stress-relaxation spaces 31 to 33 is the same as an average particle diameter of the $ZrO_2$ powders used for formation of the powder patterns before the firing.

The connection conductors 24 and 25 are formed as follows. The conductor patterns corresponding to the connection conductors 24 and 25 are formed by applying the conductive paste to the ceramic green sheet becoming the magnetic material layers 11. The application of the conductive paste is formed by the screen printing, for example. The conductor powders included in the conductor patterns are sintered by the firing and become the connection conductors 24 and 25. The through-hole conductors 12*a* to 12*d* are formed as follows. The conductive paste is filled into individual through-holes formed in the ceramic green sheet becoming the magnetic material layers 11. The conductor powders included in the conductive paste filled into the through-holes are sintered by the firing and become the through-hole conductors 12*a* to 12*d*. The conductor patterns formed on the ceramic green, sheet and the conductive paste filled into the through-holes are integrated. For this reason, the coil conductors 21 to 23 and the connection conductors 24 and 25 and the through-hole conductors 12*a* to 12*d* are formed integrally and simultaneously by the firing.

In the multilayer coil component 1 according to the first embodiment, the individual stress-relaxation spaces 31 to 33 where the powders 31*c* to 33*c* exist are in contact with the surfaces 21*d* to 23*d* of the corresponding coil conductors 21 to 23. Therefore, the stress-relaxation spaces 31 and 32 exist between the coil conductors 21 to 23 adjacent to each other in the lamination direction and the element body regions 11*a* and 11*b* located between the coil conductors 21 to 23. The stress-relaxation spaces 31 and 32 relax the internal stress occurring in the element body 2. The internal stress occurs due to a difference of thermal shrinkage rates of the coil conductors 21 to 23 and the element body 2, for example. The thicknesses La of the stress-relaxation spaces 31 to 33 are smaller than the thicknesses Lb of the element body regions 11*a* and 11*b*. That is, the thicknesses Lb of the element body regions 11*a* and 11*b* are larger than the thicknesses La of at least the stress-relaxation spaces 31 and 32. Therefore, even when the stress-relaxation spaces 31 and 32 exist between the coil conductors 21 to 23 adjacent to each other in the lamination direction and the element body regions 11*a* and 11*b* located between the coil conductors 21 to 23, the element body regions 11*a* and 11*b* secure the sufficient thicknesses as compared with the stress-relaxation spaces 31 and 32. As a result, the thicknesses Lb of the element body regions 11*a* and 11*b* are sufficiently secured, and the internal stress occurring in the element body 2 is relaxed.

In the multilayer coil component 1, the stress-relaxation spaces 31 to 33 are in contact with the surfaces 21*d* to 23*d* of the coil conductors 21 to 23. That is, the individual stress-relaxation spaces 31 to 33 are formed on the surfaces 21*d* to 23*d* of the corresponding coil conductors 21 to 23. When the stress-relaxation spaces 31 to 33 are formed on the surfaces 21*d* to 23*d*, the individual stress-relaxation spaces 31 to 33 are formed easily and the thicknesses of the element body regions 11*a* and 11*b* are secured more easily, as compared with when the stress-relaxation spaces 31 to 33 are formed on both the surfaces 21*d* to 23*d* and the surfaces 21*e*, 23*e*. The surfaces 21*e* to 23*e* on which the stress-relaxation spaces 31 to 33 are not formed are coupled to the element body 2 not via the stress-relaxation spaces 31 to 33. Therefore, coupling strength of the surfaces 21*e* to 23*e* and the element body 2 is high.

In the multilayer coil component 1, the stress-relaxation spaces 31 to 33 are in contact with the planar surfaces 21*d* to 23*d*. That is, because the surfaces 21*d* to 23*d* on which the stress-relaxation spaces 31 to 33 are formed have planar shapes, the stress-relaxation spaces 31 to 33 are formed easily.

In the multilayer coil component 1, the average particle diameter of the powders 31*c* to 33*c* is 0.1 μm or less. In which case, because fluidity of the powders 31*c* to 33*c* is superior, the powders 31*c* to 33*c* flexibly follow the behavior according to the difference of the thermal shrinkage rates of the element body 2 and the coil conductors 21 to 23. As a result, the internal stress occurring in the element body 2 is relaxed more surely.

In the multilayer coil component 1, the materials of the powders 31*c* to 33*c* are $ZrO_2$. $ZrO_2$ is hard to affect the ferrite material included in the element body 2. Because the melting point of $ZrO_2$ is higher than a firing temperature of the ferrite material included in the element body 2, $ZrO_2$ exists surely as the powders.

In the multilayer coil component 1, the individual coil conductors 21 to 23 contain the metal oxide. When the coil conductors 21 to 23 contain the metal oxide, the shrinkage rate at the time of firing the conductive paste configuring the coil conductors 21 to 23 is small as compared with when the coil conductors 21 to 23 do not contain the metal oxide. For this reason, the cross-sections of the coil conductors 21 to 23 are large. Therefore, even when the cross-sections of the coil conductors 21 to 23 are large, the stress-relaxation spaces 31 to 33 relax the internal stress occurring in the element body 2.

In the multilayer coil component 1, because the stress-relaxation space is not formed in each of the connection conductors 24 and 25, adhesion of the connection conductors 24 and 25 and the magnetic material layers 11 is superior. Therefore, intrusion of a plating solution from the ends 24*a* and 25*a* of the connection conductors 24 and 25, that is, the portions of the connection conductors 24 and 25 exposed to the end surfaces 2*a* and 2*b* is suppressed.

Second Embodiment

Figure 8:
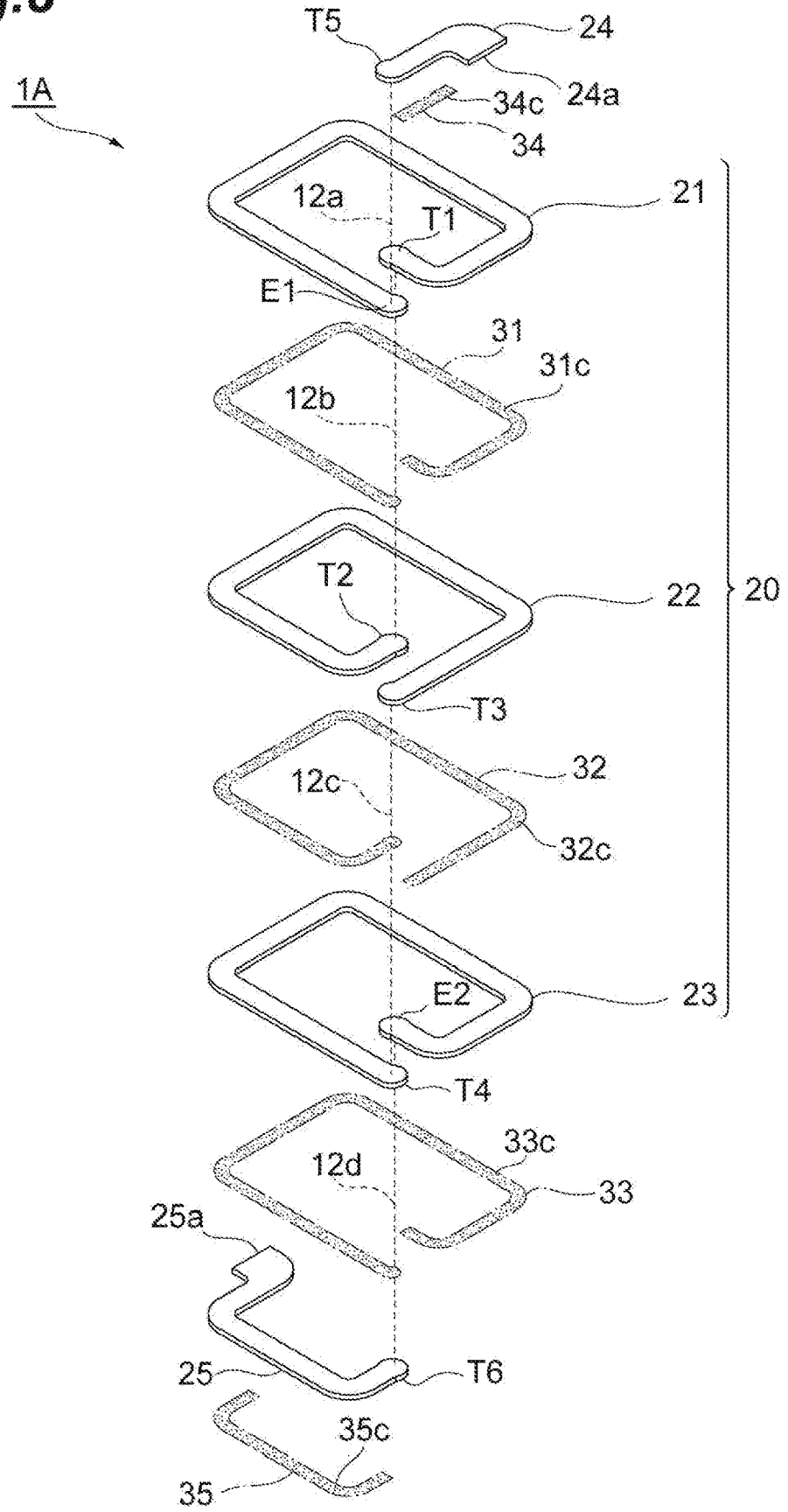
FIG. 8 is an exploded perspective view of a multilayer coil component according to a second embodiment.
Figure 9A:
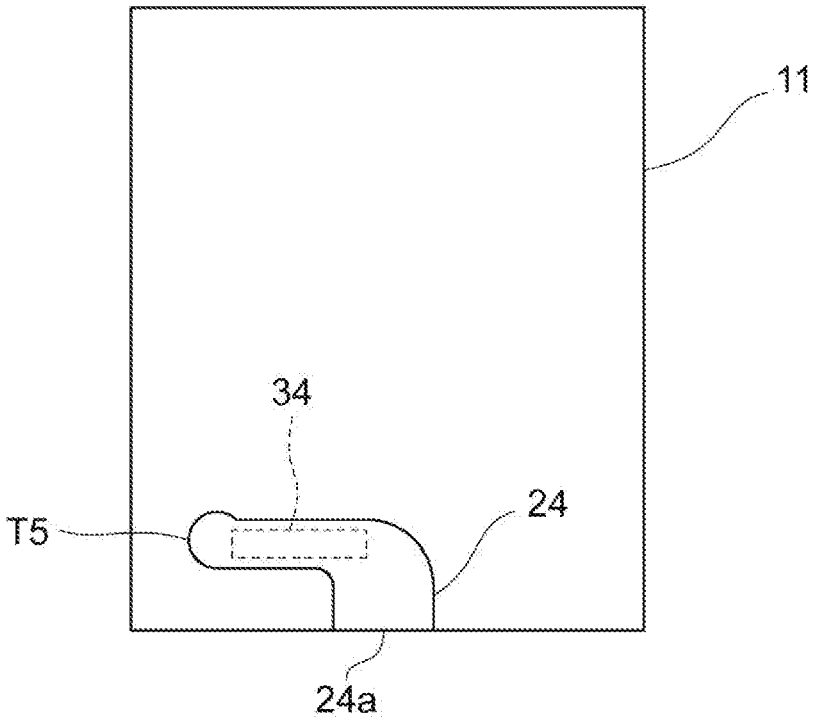
FIGS. 9A and 9B are plan views illustrating connection conductors.
Figure 9B:
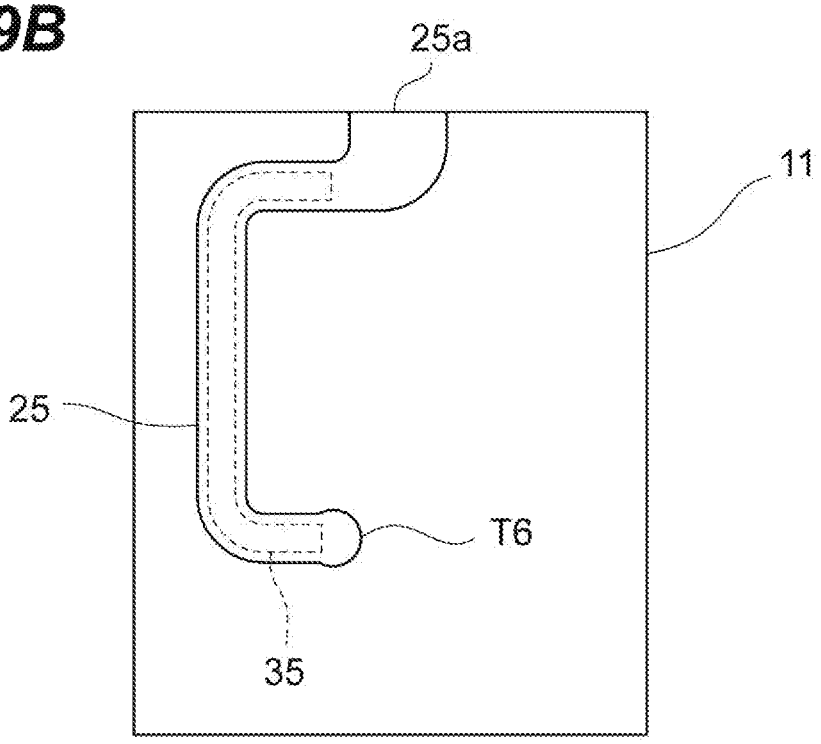
Figure 10:
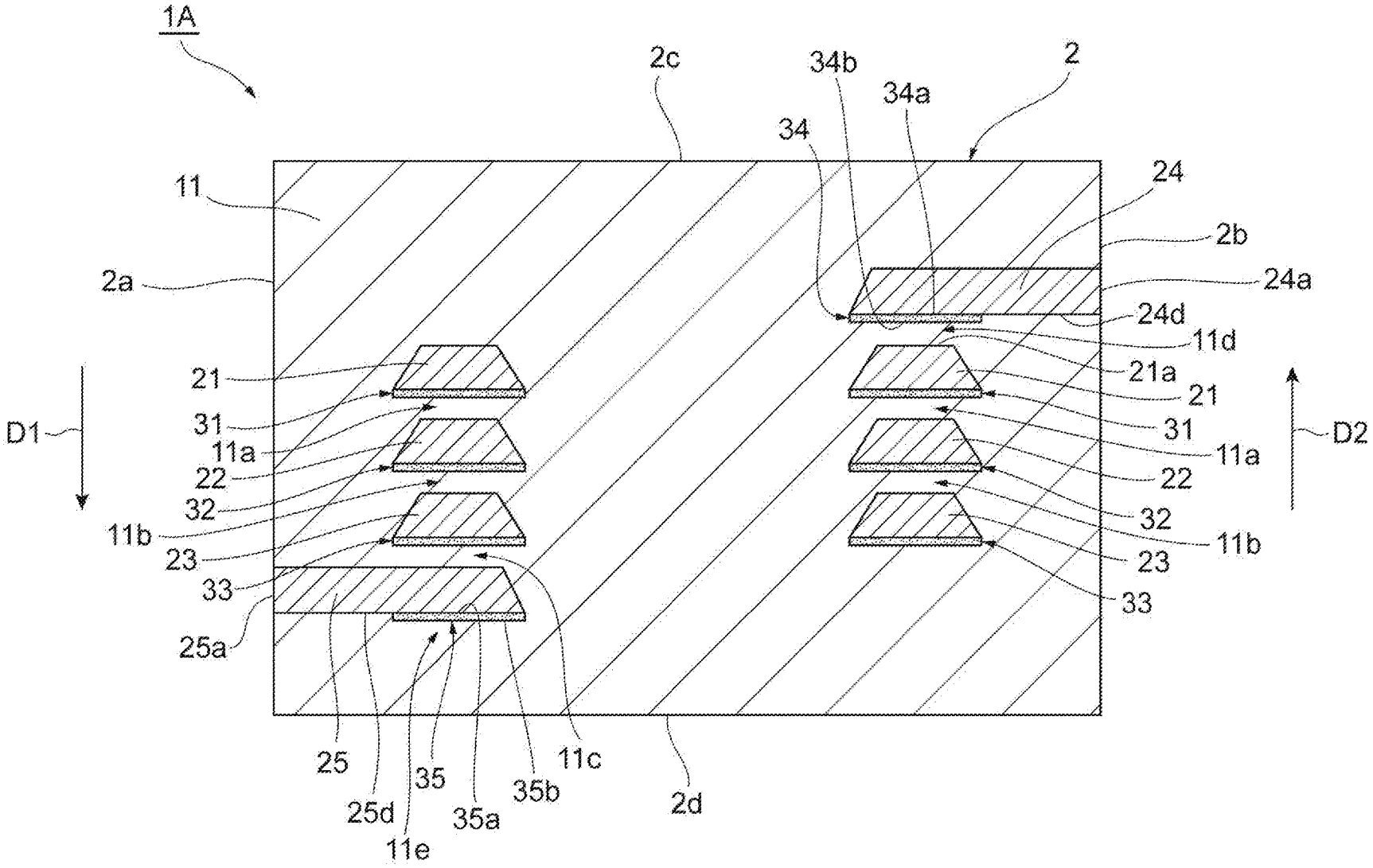
FIG. 10 is a cross-sectional view of the multilayer coil component according to the second embodiment.

A multilayer coil component 1A according to a second embodiment will be described with reference to FIGS. 8 to 10. FIG. 8 is an exploded perspective view of the multilayer coil component according to the second embodiment. FIGS. 9A and 9B are plan views illustrating connection conductors. FIG. 10 is a cross-sectional view of the multilayer coil component according to the second embodiment. FIGS. 9A and 9B correspond to FIG. 6. In FIG. 8, illustration of a plurality of magnetic material layers and external electrodes is omitted. In FIG. 10, illustration of the external electrodes is omitted. Because a perspective view of the multilayer coil component 1A according to the second embodiment is the same as that of FIG. 1, illustration is omitted.

As illustrated in FIGS. 8 to 10, the multilayer coil component 1A includes an element body 2, a pair of external electrodes 4 and 5 (refer to FIG. 1), a plurality of coil conductors 21 to 23, a plurality of connection conductors 24 and 25, and a plurality of stress-relaxation spaces 31 to 33, similar to the multilayer coil component 1. The multilayer coil component 1A is different from the multilayer coil component 1 in that the multilayer coil component 1A includes stress-relaxation spaces 34 and 35 are in contact with the connection conductors 24 and 25. The stress-relaxation spaces 34 and 35 are spaces where powders 34*c* and 35*c* exist, respectively (refer to FIG. 8). The stress-relaxation spaces 34 and 35 exist between the corresponding connection conductors 24 and 25 and element body regions in the element body 2 and relax internal stress occurring in the element body 2. Materials of the powders 34*c* and 35*c* are $ZrO_2$, for example. An average particle diameter of the powders 34*c* and 35*c* is 0.1 μm or less, for example.

As illustrated in FIG. 8, the stress-relaxation space 34 is located between the connection conductor 24 and the coil conductor 21 in a lamination direction. As illustrated in FIG. 9A, the stress-relaxation space 34 is formed on a surface 24*d* of the connection conductor 24 (refer to FIG. 10). The surface 24*d* is a lower surface of the connection conductor 24 in the lamination direction. That is, the surface 24*d* is a surface close to a side surface 2*d* in the lamination direction. The stress-relaxation space 34 is formed along a portion other than an end T5 and an end 24*a* of the connection conductor 24. That is, the stress-relaxation space 34 does not cover the end T5 and the end 24*a* of the connection conductor 24. The end T5 is a connection portion with a through-hole conductor 12*a*. The end 24*a* is a connection portion with the external electrode 4. The stress-relaxation space 34 is formed not to protrude from the connection conductor 24, when viewed from the lamination direction.

The stress-relaxation space 35 is located between the connection conductor 25 and the coil conductor 23 in the lamination direction. As illustrated in FIG. 9B, the stress-relaxation space 35 is formed on a surface 25*d* of the connection conductor 25 (refer to FIG. 10). The surface 25*d* is a lower surface of the connection conductor 25 in the lamination direction. That is, the surface 25*d* is a surface close to the side surface 2*d* in the lamination direction. The stress-relaxation space 35 is formed along a portion other than an end T6 and an end 25*a* of the connection conductor 25. That is, the stress-relaxation space 35 does not cover the end T6 and the end 25*a* of the connection conductor 25. The end T6 is a connection portion with a through-hole conductor 12*d*. The end 25*a* is a connection portion with the external electrode 4. The stress-relaxation space 35 is formed not to protrude from the connection conductor 25, when viewed from the lamination direction.

As illustrated in FIG. 10, the stress-relaxation space 34 includes a first boundary surface 34*a* with the connection conductor 24 and a second boundary surface 34*b* with an element body region 11*d*. The first boundary surface 34*a* is in contact with the surface 24*d* of the connection conductor 24. The second boundary surface 34*b* is in contact with the element body region 11*d*. In the second embodiment, the element body region 11*d* is interposed by the coil conductor 21 and the stress-relaxation space 34. In the first embodiment, the element body region 11*d* is interposed by the coil conductor 21 and the connection conductor 24. The first boundary surface 34*a* and the second boundary surface 34*b* oppose each other in the lamination direction.

The stress-relaxation space 35 includes a first boundary surface 35*a* with the connection conductor 25 and a second boundary surface 35*b* with an element body region 11*e*. The element body region 11*e* is located between the connection conductor 25 and the side surface 2*d*. The first boundary surface 35*a* is in contact with a surface 25*d* of the connection conductor 25. The second boundary surface 35*b* is in contact with the element body region 11*e*. The first boundary surface 35*a* and the second boundary surface 35*b* oppose each other in the lamination direction.

Although illustration is omitted, the thicknesses of the stress-relaxation spaces 34 and 35 in the lamination direction are defined as distances between the first boundary surfaces 34*a* and 35*a* and the second boundary surfaces 34*b* and 35*b* opposing each other, similar to the thicknesses La of the stress-relaxation spaces 34 and 35. Hereinafter, the thicknesses of the stress-relaxation spaces 34 and 35 in the lamination direction are also referred to as the "thicknesses La". The thickness La of the stress-relaxation space 34 is a distance between the first boundary surface 34*a* and the second boundary surface 34*b*. The thickness La of the stress-relaxation space 35 is a distance between the first boundary surface 35*a* and the second boundary surface 35*b*. The thicknesses La of the stress-relaxation spaces 34 and 35 are the same as the thicknesses La of the stress-relaxation spaces 31 to 33.

Although illustration is omitted, the thickness of the element body region 11*d* in the lamination direction is defined as a shortest distance of the element body region 11*d* in the lamination direction, similar to the thicknesses Lb of the element body regions 11*a* to 11*c*. The thickness of the element body region 11*d* in the lamination direction is the same as the thicknesses Lb of the element body regions 11*a* to 11*c*. Hereinafter, the thickness of the element body region 11*d* in the lamination direction is also referred to as the "thickness Lb". The thickness La of the stress-relaxation space 34 is smaller than the thickness Lb of the element body region 11*d*. That is, the thickness Lb of the element body region 11*d* is larger than the thickness La of at least the stress-relaxation space 34. Therefore, as compared with the thickness of the stress-relaxation space 34, the thickness Lb of the element body region 11*d* is sufficiently secured between the coil conductor 21 and the connection conductor 24.

The stress-relaxation spaces 34 and 35 may be completely filled with the powders 34*c* and 35*c* and gaps may be formed between the powders 34*c* and 35*c*. Even when the gaps are formed between the powders 34*c* and 35*c*, the thicknesses La of the stress-relaxation spaces 34 and 35 are defined as described above. That is, the thicknesses La of the stress-relaxation spaces 34 and 35 are defined as the thicknesses of the stress-relaxation spaces 34 and 35 including the gaps, not the thicknesses of only the regions where the powders 34*c* and 35*c* other than the gaps exist.

Similar to the first embodiment, in the second embodiment, the thicknesses Lb of the element body regions 11*a* and 11*b* are sufficiently secured, and the internal stress occurring in the element body 2 is relaxed.

In the second embodiment, because the individual stress-relaxation spaces 34 and 35 are formed in the corresponding connection conductors 24 and 25, the internal stress occurring in the element body 2 is further relaxed. The thickness Lb of the element body region 11*d* is larger than the thickness of at least the stress-relaxation space 34. Therefore, even when the stress-relaxation space 34 exists between the connection conductor 24 and the coil conductor 21 adjacent to each other in the lamination direction, the element body region 11*d* secures the sufficient thickness as compared with the stress-relaxation space 34.

In the second embodiment, the stress-relaxation spaces 34 and 35 are formed not to cover the ends 24*a* and 25*a* of the connection conductors 24 and 25, that is, portions of the connection conductors 24 and 25 exposed to end surfaces 2*a* and 2*b*. Because the ends 24*a* and 25*a* and the element body 2 are coupled not via the stress-relaxation spaces 34 and 35, adhesion of the ends 24*a* and 25*a* and the element body 2 is superior. Therefore, intrusion of a plating solution from the ends 24*a* and 25*a* is suppressed.

Third Embodiment

Figure 11:
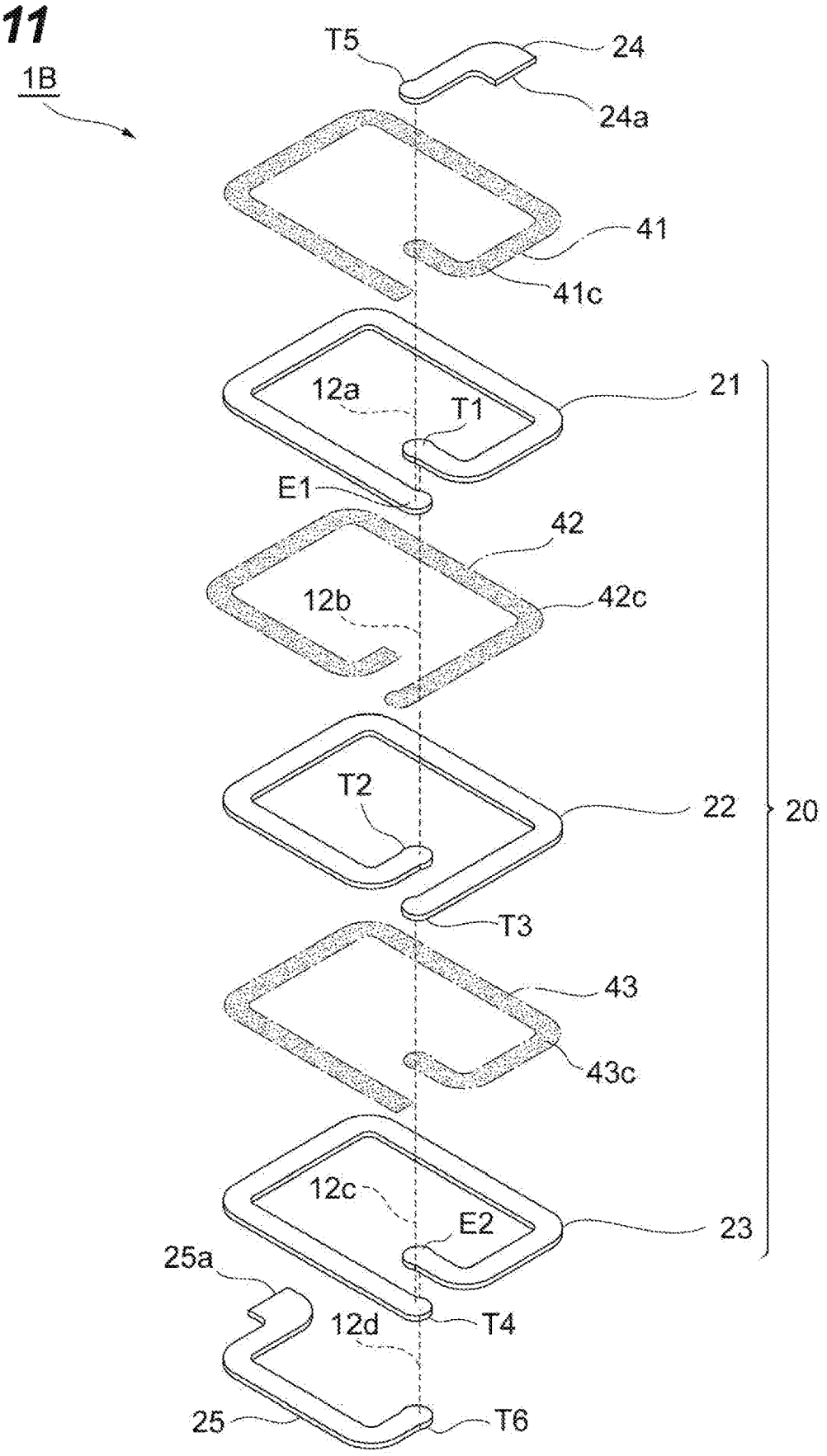
FIG. 11 is an exploded perspective view of a multilayer coil component according to a third embodiment.
Figure 12:
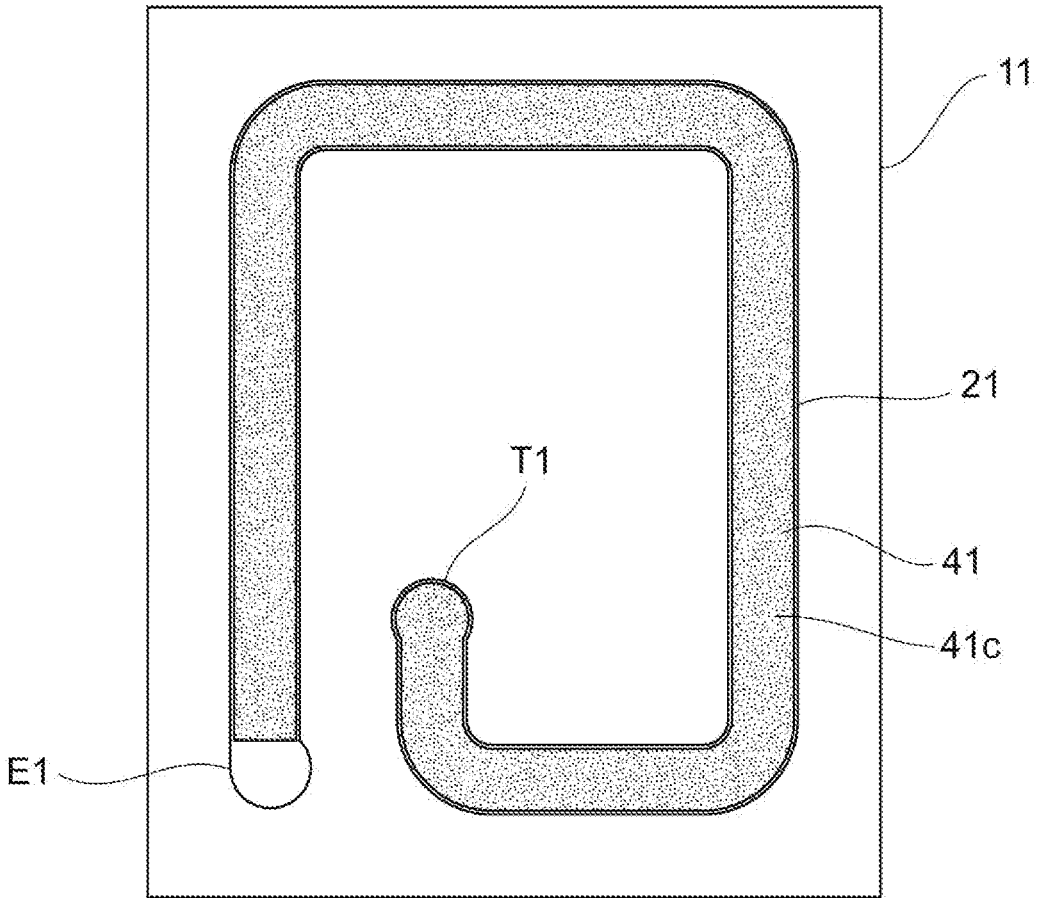
FIG. 12 is a plan view illustrating a coil conductor.
Figure 13:
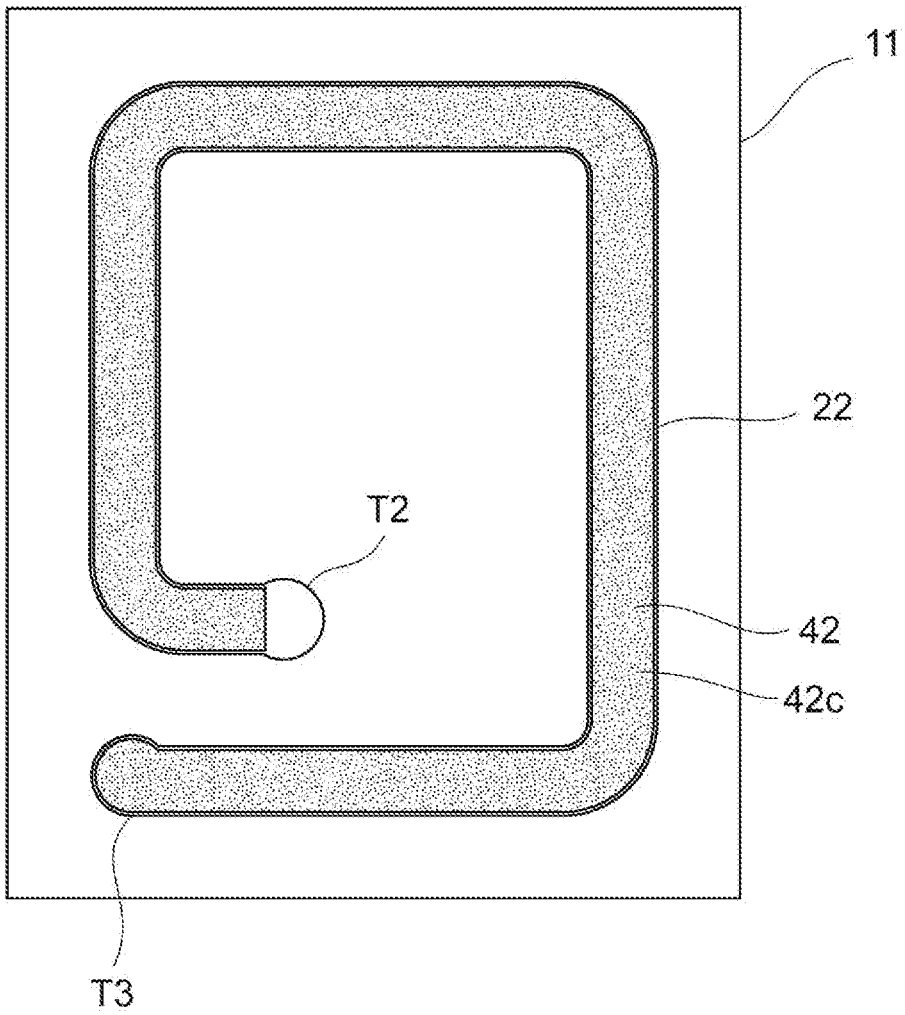
FIG. 13 is a plan view illustrating a coil conductor.
Figure 14:
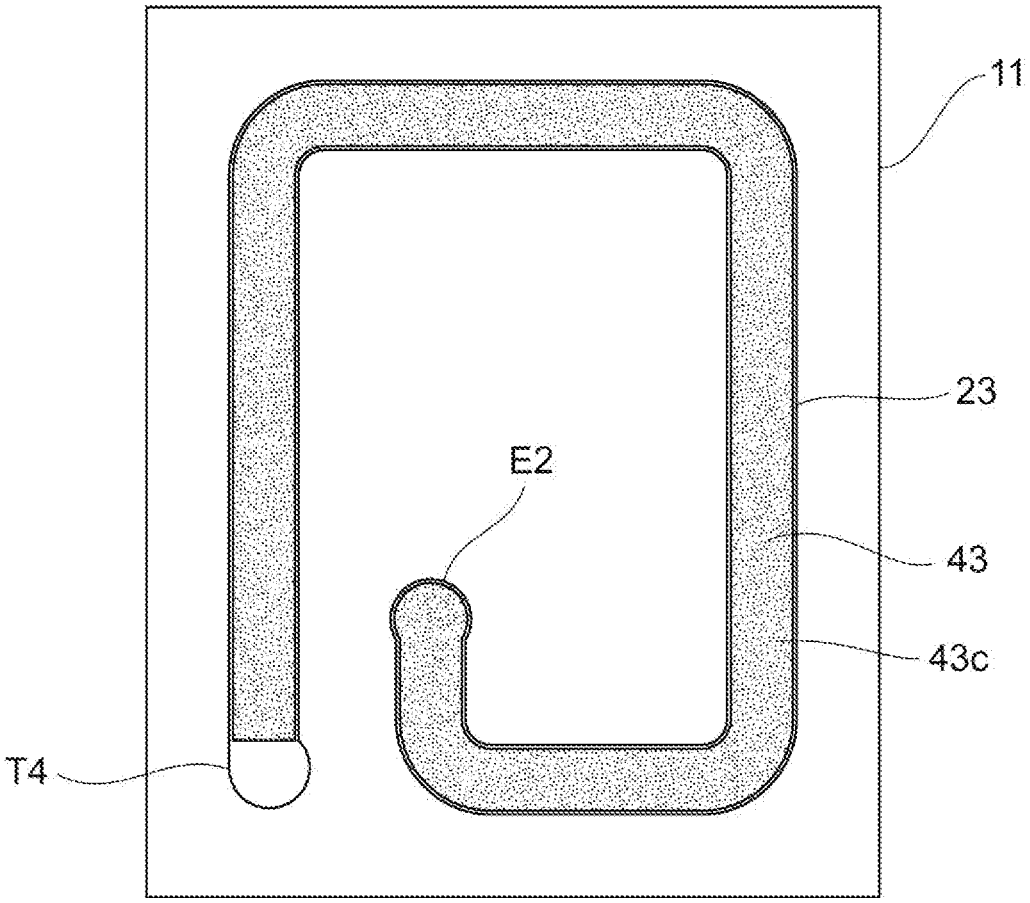
FIG. 14 is a plan view illustrating a coil conductor.
Figure 15:
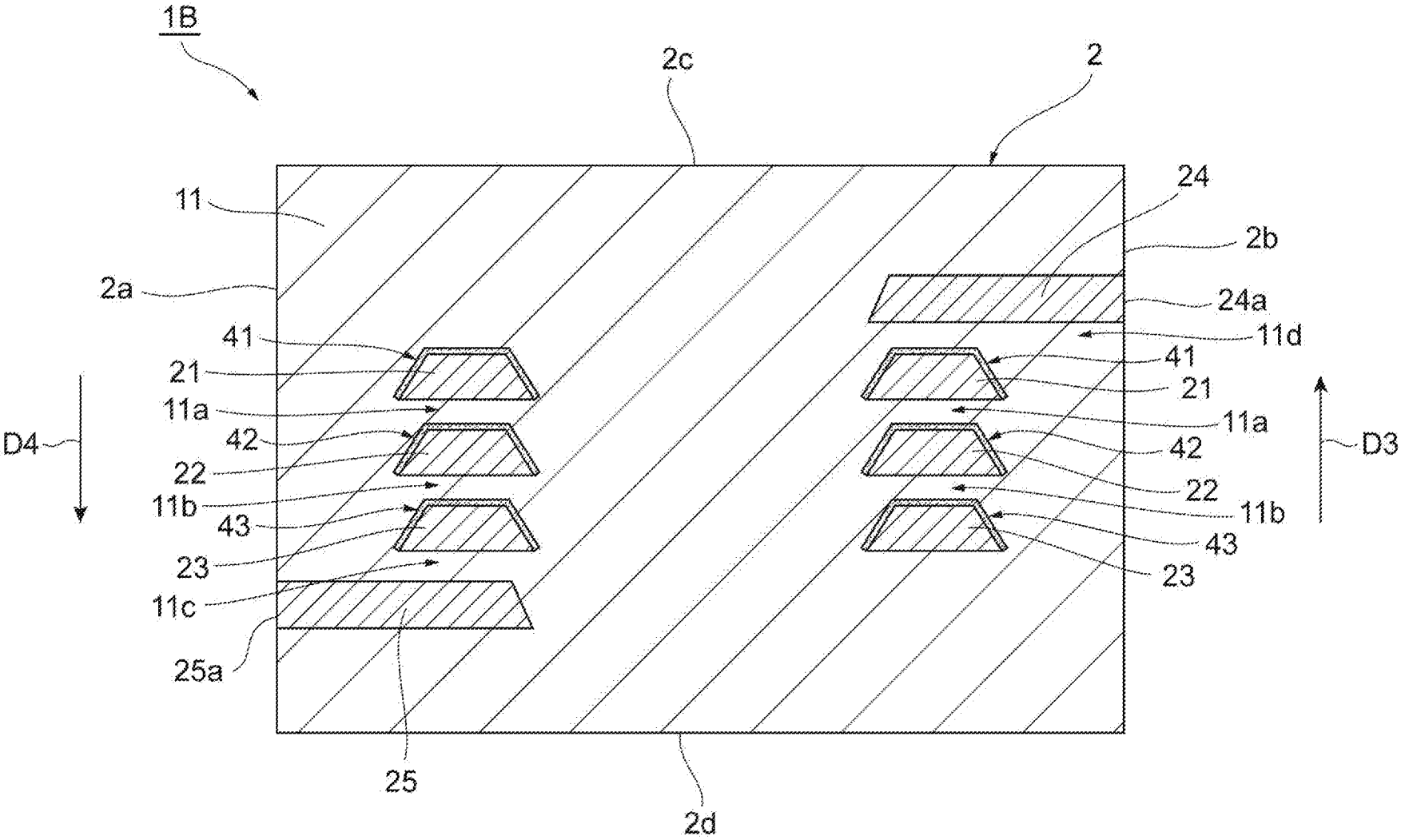
FIG. 15 is a cross-sectional view of the multilayer coil component according to the third embodiment.
Figure 16:
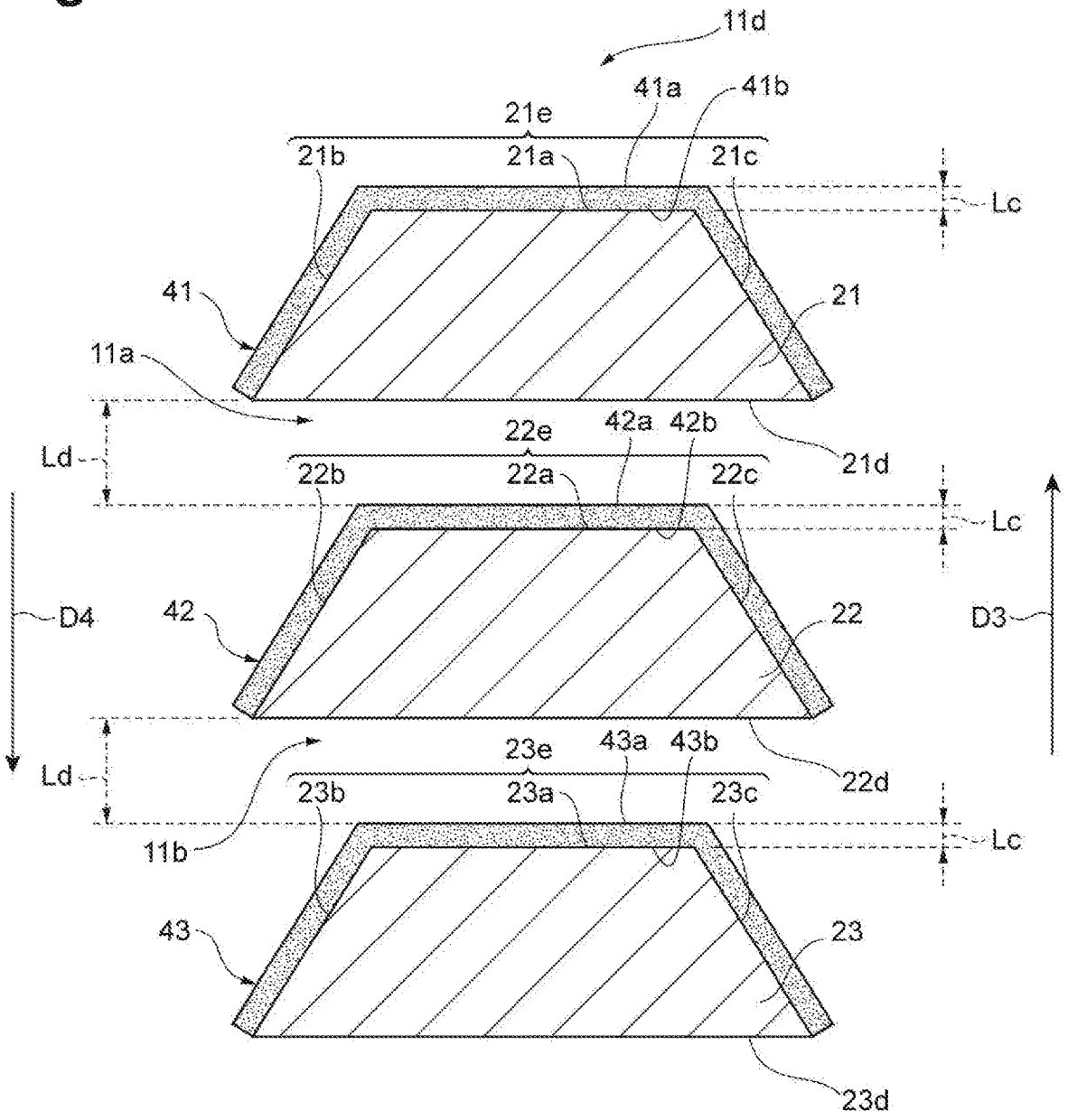
FIG. 16 is a diagram illustrating a part of FIG. 15.

A multilayer coil component 1B according to a third embodiment will be described with reference to FIGS. 11 to 16. FIG. 11 is an exploded perspective view of the multilayer coil component according to the third embodiment. FIGS. 12 to 14 are plan views illustrating coil conductors. FIG. 15 is a cross-sectional view of the multilayer coil component according to the third embodiment. FIG. 15 corresponds to FIG. 6. FIG. 16 is a diagram illustrating a part of FIG. 15. In FIG. 11, illustration of a plurality of magnetic material layers and external electrodes is omitted. In FIG. 15, illustration of the external electrodes is omitted. Because a perspective view of the multilayer coil component 1B according to the third embodiment is the same as that of FIG. 1, illustration is omitted.

As illustrated in FIGS. 11 to 16, the multilayer coil component 1B includes an element body 2, a pair of external electrodes 4 and 5 (refer to FIG. 1), a plurality of coil conductors 21 to 23, and a plurality of connection conductors 24 and 25, similar to the multilayer coil component 1. The multilayer coil component 1B is different from the multilayer coil component 1 in that the multilayer coil component 1B includes a plurality of stress-relaxation spaces 41 to 43, instead of the plurality of stress-relaxation spaces 31 to 33.

The individual stress-relaxation spaces 41 to 43 are in contact with the corresponding coil conductors 21 to 23. The stress-relaxation spaces 41 to 43 are spaces where powders 41*c*, 42*c*, and 43*c* exist, respectively. The individual stress-relaxation spaces 41 to 43 exist between the corresponding coil conductors 21 to 23 and element body regions in the element body 2 and relax internal stress occurring in the element body 2. Materials of the powders 41*c*, 42*c*, and 43*c* are $ZrO_2$, for example. An average particle diameter of the powders 41*c*, 42*c*, and 43*c* is 0.1 μm or less, for example.

As illustrated in FIG. 11, the stress-relaxation space 41 is located between the connection conductor 24 and the coil conductor 21 in a lamination direction. As illustrated in FIG. 12, the stress-relaxation space 41 is formed on a surface 21*e* of the coil conductor 21 (refer to FIG. 16). The surface 21*e* is an upper surface of the coil conductor 21 in the lamination direction. That is, the surface 21*e* is a surface close to a side surface 2*c* in the lamination, direction. The stress-relaxation space 41 is formed along a portion other than an end E1 of the coil conductor 21. That is, the stress-relaxation space 41 does not cover the end E1 of the coil conductor 21. The end E1 is a connection portion with a through-hole conductor 12*a*. The stress-relaxation space 41 is formed not to protrude from the coil conductor 21, when viewed from the lamination direction.

The stress-relaxation space 42 is located between the coil conductor 21 and the coil conductor 22 in the lamination direction. As illustrated in FIG. 13, the stress-relaxation space 42 is formed on a surface 22*e* of the coil conductor 22 (refer to FIG. 16). The surface 22*e* is an upper surface of the coil conductor 21 in the lamination direction. That is, the surface 22*e* is a surface close to the side surface 2*c*. The stress-relaxation space 42 is formed along a portion other than an end T2 of the coil conductor 22. That is, the stress-relaxation space 42 does not cover the end T2 of the coil conductor 22. The end T2 is a connection portion with a through-hole conductor 12*b*. The stress-relaxation space 42 is formed not to protrude from the coil conductor 22, when viewed from the lamination direction.

The stress-relaxation space 43 is located between the coil conductor 22 and the coil conductor 23 in the lamination direction. As illustrated in FIG. 14, the stress-relaxation space 43 is formed on a surface 23*e* of the coil conductor 23 (refer to FIG. 16). The surface 23*e* is an upper surface of the coil conductor 21 in the lamination direction. That is, the surface 23*e* is a surface close to the side surface 2*c*. The stress-relaxation space 43 is formed along a portion other than an end T4 of the coil conductor 23. That is, the stress-relaxation space 43 does not cover the end T4 of the coil conductor 23. The end T4 is a connection portion with a through-hole conductor 12*c*. The stress-relaxation space 43 is formed not to protrude from the coil conductor 23, when viewed from the lamination direction.

As illustrated in FIG. 15, in the third embodiment, an element body region 11*a* is interposed by the coil conductor 21 and the stress-relaxation space 42. An element body region 11*b* is interposed by the coil conductor 22 and the stress-relaxation space 43. An element body region 11*c* is interposed by the coil conductor 23 and the connection conductor 25. An element body region 11*d* is interposed by the connection conductor 24 and the stress-relaxation space 41.

Referring to FIG. 16, cross-sectional configurations of each of the coil conductors 21 to 23 and each of the stress-relaxation spaces 41 to 43 will be described. In FIG. 16, regions including parts (portions close to an end surface 2*b* of the element body 2) of the coil conductors 21 to 23 in FIG. 15 are expanded. Because configurations of regions including portions of the coil conductors 21 to 23 close to an end surface 2*a* of the element body 2 in FIG. 15 are the same as the configurations illustrated in FIG. 16, illustration is omitted. In the third embodiment, a direction toward the side surface 2*c* from a side surface 2*d* is one direction D3 of the lamination direction and a direction toward the side surface 2*d* from the side surface 2*c* is the other direction D4 of the lamination direction. That is, in the third embodiment, the surfaces 21*e*, 22*e*, and 23*e* are first surfaces facing one direction D3 of the lamination direction and surfaces 21*d*, 22*d*, and 23*d* are second surfaces facing the other direction D4 of the lamination direction.

As illustrated in FIG. 16, the stress-relaxation space 41 includes a first boundary surface 41*b* with the coil conductor 21 and a second boundary surface 41*a* with the element body region 11*d*. The first boundary surface 41*b* is in contact with the surface 21*e* of the coil conductor 21. That is, the first boundary surface 41*b* is in contact with a planar portion 21*a* and inclined portions 21*b* and 21*c*. In the third embodiment, the first boundary surface 41*b* continuously is in contact with the planar portion 21*a* and the inclined portions 21*b* and 21*c*. The stress-relaxation space 41 covers the planar portion 21*a* and the inclined portions 21*b* and 21*c* integrally. The second boundary surface 41*a* is in contact with the element body region 11*d*. The first boundary surface 41*b* and the second boundary surface 41*a* oppose each other in the lamination direction.

The stress-relaxation space 42 includes a first boundary surface 42*b* with the coil conductor 22 and a second boundary surface 42*a* with an element body region 11*a*. The first boundary surface 42*b* is in contact with the surface 22*e* of the coil conductor 22. That is, the first boundary surface 42*b* is in contact with a planar portion 22*a* and inclined portions 22*b* and 22*c*. In the third embodiment, the first boundary surface 42*b* continuously is in contact with the planar portion 22*a* and the inclined portions 22*b* and 22*c*. The stress-relaxation space 42 covers the planar portion 22*a* and the inclined portions 22*b* and 22*c* integrally. The second boundary surface 42*a* is in contact with the element body region 11*a*. The first boundary surface 42*b* and the second boundary surface 42*a* oppose each other in the lamination direction.

The stress-relaxation space 43 includes a first boundary surface 43*b* with the coil conductor 23 and a second boundary surface 43*a* with the element body region 11*b*. The first boundary surface 43*b* is in contact with the surface 23*e* of the coil conductor 23. That is, the first boundary surface 43*b* is in contact with a planar portion 23*a* and inclined portions 23*b* and 23*c*. In the third embodiment, the first boundary surface 43*b* continuously is in contact with the planar portion 23*a* and the inclined portions 23*b* and 23*c*. The stress-relaxation space 43 covers the planar portion 23*a* and the inclined portions 23*b* and 23*c* integrally. The second boundary surface 43*a* is in contact with the element body region 11*b*. The first boundary surface 43*b* and the second boundary surface 43*a* oppose each other in the lamination direction.

The thicknesses (hereinafter, simply referred to as the "thicknesses Lc") of the individual stress-relaxation spaces 41 to 43 in the lamination direction are defined as distances between the first boundary surfaces 41*b* to 43*b* and the second boundary surfaces 41*a* to 43*a* opposing each other. In the third embodiment, the thickness Lc of the stress-relaxation space 41 is a distance between the first boundary surface 41*b* and the second boundary surface 41*a*. The thickness Lc of the stress-relaxation space 42 is a distance between the first boundary surface 42*b* and the second boundary surface 42*a*. The thickness Lc of the stress-relaxation space 43 is a distance between the first boundary surface 43*b* and the second boundary surface 43*a*. The thicknesses Lc of the individual stress-relaxation spaces 41 to 43 are the same.

The thicknesses (hereinafter, simply referred to as the "thicknesses Ld") of the individual element body regions 11*a* and 11*b* in the lamination direction are defined as shortest distances of the element body regions 11*a* and 11*b* in the lamination direction. In the third embodiment, the thickness Ld of the element body region 11*a* is a distance between the second boundary surface 42*a* and the surface 21*d*. The thickness Ld of the element body region 11*b* is a distance between the second boundary surface 43*a* and the surface 22*d*. The thicknesses Ld of the individual element body regions 11*a* and 11*b* are the same.

The thicknesses Lc of the individual stress-relaxation spaces 41 to 43 are smaller than the thicknesses Ld of the individual element body regions 11*a* and 11*b*. That is, the thicknesses Ld of the element body regions 11*a* and 11*b* are larger than the thicknesses Lc of at least the stress-relaxation spaces 41 to 43. Therefore, as compared with the thickness of the stress-relaxation space 41, the thickness Ld of the element body region 11*a* is sufficiently secured between the coil conductor 21 and the coil conductor 22. As compared with the thickness of the stress-relaxation space 42, the thickness Ld of the element body region 11*b* is sufficiently secured between the coil conductor 22 and the coil conductor 23. The thicknesses L of the stress-relaxation spaces 41 to 43 are about 1 to 2 μm, for example. Meanwhile, the thicknesses Ld of the element body regions 11*a* and 11*b* are about 3 to 30 μm, for example. A difference of the thicknesses Lc of the element body regions 11*a* and 11*b* and the thicknesses Ld of the stress-relaxation spaces 41 to 43 may be 5 to 20, for example.

Although illustration is omitted, the thickness of the element body region 11*d* in the lamination direction is defined as a shortest distance of the element body region 11*d* in the lamination direction, similar to the thicknesses Lc of the element body regions 11*a* and 11*b*. The thickness of the element body region 11*d* in the lamination direction is the same as the thicknesses Lc of the element body regions 11*a* and 11*b*. Hereinafter, the thickness of the element body region 11*d* in the lamination direction is also simply referred to as the "thickness Lc". The thickness La of the stress-relaxation space 41 is smaller than the thickness Ld of the element body region 11*d*. That is, the thickness Ld of the element body region 11*d* is larger than the thickness Lc of at least the stress-relaxation space 41. Therefore, as compared with the thickness of the stress-relaxation space 41, the thickness Ld of the element body region 11*d* is sufficiently secured between the coil conductor 21 and the connection conductor 24.

The stress-relaxation spaces 41 to 43 may be completely filled with the powders 41*c* to 43*c* and gaps may be formed between the powders 41*c* to 43*c*, similar to the first and second embodiments. Even when the gaps are formed between the powders 41*c* to 43*c*, the thicknesses Lc of the stress-relaxation spaces 41 to 43 are defined as described above. That is, the thicknesses Lc of the stress-relaxation spaces 41 to 43 are defined as the thicknesses of the stress-relaxation spaces 41 to 43 including the gaps, not the thicknesses of only the regions where the powders 41*c* to 43*c* other than the gaps exist.

The element body regions 11*a*, 11*b*, and 11*d* may not be in contact with the conductors 21 to 25, similar to the element body regions 11*a* to 11*c*. Even when the gaps are formed between the element body regions 11*a* to 11*c* and the conductors 21 to 25, the thicknesses Ld of the element body regions 11*a*, 11*b*, and 11*d* are defined as the shortest distances of the element body regions 11*a*, 11*b*, and 11*d* in the lamination direction, as described above. When the gaps are formed between the element body regions 11*a* to 11*c* and the conductors 21 to 25, the shortest distances of the element body regions 11*a*, 11*b*, and 11*d* in the lamination direction become small as compared with when the gaps are not formed. For example, when the gap is not formed between the element body region 11*a* and the coil conductor 21, the thickness Ld of the element body region 11*a* is a distance between the second boundary surface 42*a* and the surface 21*d*. For example, when the gap is formed between the element body region 11*a* and the coil conductor 21 (surface 21*d*), the thickness Ld of the element body region 11*a* is a distance between the second boundary surface 42*a* and a boundary surface with the gap. For example, when the gap is not formed between the element body region 11*b* and the coil conductor 22, the thickness Ld of the element body region 11*b* is a distance between the second boundary surface 43*a* and the surface 22*d*. For example, when the gap is formed between the element body region 11*b* and the coil conductor 22 (surface 22*d*), the thickness Ld of the element body region 11*b* is a distance between the second boundary surface 43*a* and a boundary surface with the gap.

Next, a course of forming conductor patterns corresponding to the individual coil conductors 21 to 23 and powder patterns corresponding to the individual stress-relaxation spaces 41 to 43 on a non-burned ceramic green sheet becoming magnetic material layers 11 will be described. Because a method of forming the individual connection conductors 24 and 25 and a method of forming the individual through-hole conductors 12*a* to 12*d* are the same as those in the first embodiment, explanation thereof is omitted.

First, the conductor patterns becoming the individual coil conductors 21 to 23 after firing are formed on the ceramic green sheet by applying the conductive paste. The application of the conductive paste is performed by screen printing, for example. The conductive paste is made by mixing conductor powders and organic solvents and organic binders. Next, the powder patterns becoming the individual stress-relaxation spaces 41 to 43 after the firing are formed on the individual conductor patterns formed on the ceramic green sheet by applying paste including $ZrO_2$. The application of the paste is performed by the screen printing, for example. The paste including $ZrO_2$ is made by mixing $ZrO_2$ powders and organic solvents and organic binders. The conductor powders included in the conductor patterns become are sintered by the firing and become the coil conductors 21 to 23. The powder patterns become the stress-relaxation spaces 41 to 43 where the powders 41*c* to 43*c* exist, by the firing. An average particle diameter of the powders 41*c* to 43*c* existing in the stress-relaxation spaces 41 to 43 is the same as an average particle diameter of the $ZrO_2$ powders used for formation of the powder patterns before the firing.

In the multilayer coil component 1B according to the third embodiment, the individual stress-relaxation spaces 41 to 43 where the powders 41*c* to 43*c* exist are in contact with the surfaces 21*e* to 23*e* of the corresponding coil conductors 21 to 23. Therefore, the stress-relaxation spaces 42 and 43 exist between the coil conductors 21 to 23 adjacent to each other in the lamination direction and the element body regions 11*a* and 11*b* located between the coil conductors 21 to 23. The stress-relaxation spaces 41 to 43 relax the internal stress occurring in the element body 2. The internal stress occurs due to a difference of thermal shrinkage rates of the coil conductors 21 to 23 and the element body 2, for example.

The thicknesses Lc of the stress-relaxation spaces 41 to 43 are smaller than the thicknesses Ld of the element body regions 11*a* and 11*b*. That is, the thicknesses Ld of the element body regions 11*a* and 11*b* are larger than the thicknesses Le of at least the stress-relaxation spaces 41 to 43. Therefore, even when the stress-relaxation spaces 42 and 43 exist between the coil conductors 21 to 23 adjacent to each other in the lamination direction and the element body regions 11*a* and 11*b* located between the coil conductors 21 to 23, the element body regions 11*a* and 11*b* secure the sufficient thicknesses as compared with the stress-relaxation spaces 42 and 43. As a result, the thicknesses Ld of the element body regions 11*a* and 11*b* are sufficiently secured, and the internal stress occurring in the element body 2 is relaxed.

In the multilayer coil component 1B, the stress-relaxation spaces 41 to 43 are in contact with the planar portions 21*a* to 23*a* and the inclined portions 21*b* to 23*b* and 21*c* to 23*c*. For this reason, the internal stress occurring in the element body 2 is relaxed surely.

The various embodiments have been described. However, the present invention is not limited to the embodiments and various changes, modifications, and applications can be made without departing from the gist of the present invention.

In the embodiments, the stress-relaxation spaces 31 to 33 and 41 to 43 are in contact with the surfaces facing one direction D1 and D3 of the lamination direction in the corresponding coil conductors 21 to 23. However, the present invention is not limited thereto. For example, the stress-relaxation spaces may be in contact with the surfaces facing one direction D1 and D3 of the lamination direction and the surfaces facing the other directions D2 and D4 of the lamination direction in the coil conductors 21 to 23. The stress-relaxation spaces 31 to 33 and 41 to 43 may be in contact with the parts of the surfaces of the corresponding coil conductors 21 to 23 and may be in contact with the entire portions of the surfaces of the corresponding coil conductors 21 to 23. The stress-relaxation spaces 31 to 33 and 41 to 43 may be formed to surround the surfaces of the corresponding coil conductors 21 to 23. In the embodiments, the stress-relaxation spaces 31 to 33 and 41 to 43 are formed not to protrude from the corresponding coil conductors 21 to 23, when viewed from the lamination direction. However, the present invention is not limited thereto. For example, the stress-relaxation spaces 31 to 33 and 41 to 43 may be formed to protrude from the corresponding coil conductors 21 to 23, when viewed from the lamination direction. In the embodiments, the stress-relaxation spaces 34 and 35 are formed not to protrude from the connection conductors 24 and 25, when viewed from the lamination direction. However, the present invention is not limited thereto. For example, the stress-relaxation spaces 34 and 35 may be formed to protrude from the connection conductors 24 and 25, when viewed from the lamination direction.

In the embodiments, the cross-sectional shapes of the coil conductors 21 to 23 are approximately the trapezoidal shapes. However, the present invention is not limited thereto. For example, the cross-sectional shapes of the coil conductors 21 to 23 may be approximately rectangular shapes.

In the embodiments, the thicknesses of the coil conductors 21 to 23 and the connection conductors 24 and 25 in the lamination direction are approximately the same. However, the present invention is not limited thereto. For example, the thicknesses of the connection conductors 24 and 25 in the lamination direction may be smaller than the thicknesses of the coil conductors 21 to 23. In this case, the stress is suppressed from occurring in the element body 2 due to the connection conductors 24 and 25. When the thickness of the connection conductor 24 in the lamination direction is small, electrical resistance of the connection conductor 24 increases. For this reason, the electrical resistance of the connection conductor 24 may be decreased by placing the plurality of connection conductors 24 side by side in the lamination direction. Likewise, the electrical resistance of the connection conductor 25 may be decreased by placing the plurality of connection conductors 25 side by side in the lamination direction.

In the embodiments, the materials of the powders 31*c* to 35*c* and 41*c* to 43*c* are $ZrO_2$, for example. However, the present invention is not limited thereto. For example, the materials of the powders 31*c* to 35*c* and 41*c* to 43*c* may be ferrite materials having a higher firing temperature than the ferrite material configuring the element body 2. In which case, the stress-relaxation spaces 31 to 35 and 41 to 43 where the powders 31*c* to 35*c* and 41*c* to 43*c* exist also function as magnetic materials. The materials of the powders configuring the stress-relaxation spaces 31 to 33 and 41 to 43 may be materials having higher permittivity than the element body 2. In which case, stray capacitance occurring between the coil conductors 21 to 23 is reduced.

In the third embodiment, the stress-relaxation spaces may be formed in the connection conductors 24 and 25.

What is claimed is:

1. A multilayer coil component comprising:

an element body that includes a magnetic material;

a coil configured to include a plurality of internal conductors separated from each other in a first direction in the element body and electrically connected to each other; and a plurality of stress-relaxation spaces configured to be in contact with surfaces of the plurality of internal conductors, wherein the element body includes element body regions located between each pair of one of the plurality of internal conductors and one of the plurality of stress-relaxation spaces adjacent to each other in the first direction, each of the plurality of stress-relaxation spaces includes non-sintered powders in a final state of the each of the plurality of stress-relaxation spaces, a first boundary surface with an internal conductor of the plurality of internal conductors, and a second boundary surface with one of the element body regions, the first boundary surface and the second boundary surface oppose each other in the first direction, a distance between the first boundary surface and the second boundary surface is smaller than a thickness of each of the element body regions in the first direction.

2. The multilayer coil component according to claim 1, wherein each of the plurality of internal conductors includes a first surface facing one direction of the first direction and a second surface facing the other direction of the first direction, and the first surface is in contact with the first boundary surface.

3. The multilayer coil component according to claim 2, wherein the first surface has a planar shape.

4. The multilayer coil component according to claim 2, wherein the first surface includes a first surface portion extending in a direction orthogonal to the first direction and a second surface portion inclined with respect to the first direction and the first surface portion, and the each stress-relaxation space is in contact with the first surface portion and the second surface portion.

5. The multilayer coil component according to claim 2, wherein the second surface does not contact the plurality of stress-relaxation spaces.

6. The multilayer coil component according to claim 1, wherein an average particle diameter of the powders is 0.1 μm or less.

7. The multilayer coil component according to claim 1, wherein materials of the powders are $ZrO_2$.

8. The multilayer coil component according to claim 1, wherein each of the plurality of internal conductors contains metal oxide.

* * * * *